US010597963B2

(12) United States Patent
Kordex et al.

(10) Patent No.: US 10,597,963 B2
(45) Date of Patent: Mar. 24, 2020

(54) CORING TOOLS INCLUDING A CORE CATCHER

(71) Applicant: Baker Hughes Oilfield Operations LLC, Houston, TX (US)

(72) Inventors: Phil Kordex, Hannover (DE); Thomas Uhlenberg, Niedersachsen (DE); Christoph Wesemeier, Hannover (DE)

(73) Assignee: Baker Hughes Oilfield Operations LLC, Houston, TX (US)

( * ) Notice: Subject to any disclaimer, the term of this patent is extended or adjusted under 35 U.S.C. 154(b) by 39 days.

(21) Appl. No.: 15/963,479

(22) Filed: Apr. 26, 2018

(65) Prior Publication Data

US 2019/0330948 A1 Oct. 31, 2019

(51) Int. Cl.

| | |
|---|---|
| ***E21B 25/10*** | (2006.01) |
| *E21B 10/60* | (2006.01) |
| *E21B 10/02* | (2006.01) |

(52) U.S. Cl.

CPC ..... *E21B 25/10* (2013.01); *E21B 10/02* (2013.01); *E21B 10/605* (2013.01)

(58) Field of Classification Search

CPC ..... E21B 25/10
USPC ..... 175/58
See application file for complete search history.

(56) References Cited

U.S. PATENT DOCUMENTS

| | | | | |
|---|---|---|---|---|
| 4,651,835 | A * | 3/1987 | Davis | E21B 25/12 175/250 |
| 5,146,999 | A | 9/1992 | Wiser et al. | |
| 6,145,604 | A | 11/2000 | Bartette | |
| 7,776,256 | B2 | 8/2010 | Smith et al. | |
| 7,802,495 | B2 | 9/2010 | Oxford et al. | |
| 8,499,856 | B2 | 8/2013 | Kumar | |
| 8,991,471 | B2 | 3/2015 | Cheng et al. | |
| 9,598,911 | B2 | 3/2017 | Uhlenberg et al. | |

(Continued)

FOREIGN PATENT DOCUMENTS

| | | | |
|---|---|---|---|
| JP | 2013-217088 | A | 10/2013 |
| WO | 2015010003 | A1 | 1/2015 |
| WO | 2015035147 | A1 | 3/2015 |

OTHER PUBLICATIONS

International Search Report for International Application No. PCT/US2019/028498 dated Aug. 26, 2019, 3 pages.

(Continued)

*Primary Examiner* — Taras P Bemko
(74) *Attorney, Agent, or Firm* — TraskBritt

(57) ABSTRACT

A core catcher for a coring tool comprises a sleeve comprising a longitudinal axis and at least one slit extending at least partially along a height of the sleeve between an upper end and a lower end thereof. The at least one slit separates a first side surface and a second side surface of the sleeve. The first and second side surfaces are located a first distance and a second distance from the longitudinal axis, respectively, measured in a direction transverse to the longitudinal axis. The core catcher further comprises a bridging element extending at least partially about a sleeve perimeter. The bridging element operatively couples movement of the first side surface and the second side surface to limit a difference between the first and second distances as a width of the at least one slit that separates the first side surface and the second side surface increases or decreases.

17 Claims, 12 Drawing Sheets

(56) References Cited

U.S. PATENT DOCUMENTS

| | | | | |
|---|---|---|---|---|
| 2003/0168870 | A1* | 9/2003 | Spencer | G01N 1/08 294/50.7 |
| 2011/0100718 | A1* | 5/2011 | Drenth | E21B 25/12 175/246 |
| 2015/0021096 | A1 | 1/2015 | Wesemeier et al. | |
| 2015/0021097 | A1 | 1/2015 | Wesemeier et al. | |
| 2015/0068812 | A1 | 3/2015 | Wesemeier et al. | |
| 2015/0247369 | A1 | 9/2015 | Beach | |
| 2015/0322722 | A1 | 11/2015 | Uhlenberg et al. | |
| 2016/0258223 | A1 | 9/2016 | Uhlenberg et al. | |
| 2017/0282457 | A1 | 10/2017 | Burns et al. | |

OTHER PUBLICATIONS

International Written Opinion for International Application No. PCT/US2019/028498 dated Aug. 26, 2019, 5 pages.

* cited by examiner

CORING TOOLS INCLUDING A CORE CATCHER

TECHNICAL FIELD

The present disclosure, in various embodiments, relates generally to core catchers for coring tools and methods of forming the core catcher. More particularly, the present disclosure relates to core catchers including features configured to couple axial and/or radial movement of a sleeve of the core catcher and to inhibit distortion of the core catcher that may result in loss of a core of subterranean formation material therefrom.

BACKGROUND

Formation coring is a well-known process in the oil and gas industry. In conventional coring operations, a core barrel assembly is used to cut a core from the subterranean formation and to transport the core to the surface for analysis. Analysis of the core can reveal invaluable data concerning subsurface geological formations—including parameters such as permeability, porosity, and fluid saturation—that are useful in the exploration for and production of petroleum, natural gas, and minerals. Such data may also be useful for construction site evaluation and in quarrying operations.

A conventional core barrel assembly typically includes an outer barrel having, at a bottom end, a core bit adapted to cut the core and to receive the core in a central opening, or throat. The opposing end of the outer barrel is attached to the end of a drill string, which conventionally comprises a plurality of tubular sections, that extends to the surface. An inner barrel assembly having an inner tube configured for retaining the core is located within and releasably attached to the outer barrel. The inner barrel assembly further includes a core shoe disposed at one end of the inner tube adjacent the throat of the core bit. The core shoe is configured to receive the core as it enters the throat and to guide the core into the inner tube. Both the inner tube and core shoe are suspended within the outer barrel with structure permitting the core bit and outer barrel to rotate freely with respect to the inner tube and core shoe, which may remain substantially rotationally stationary or which may rotate limitedly due to frictional forces. Thus, as the core is cut—by application of weight to the core bit through the outer barrel and drill string in conjunction with rotation of these components—the core will traverse the throat of the core bit to eventually reach the substantially rotationally stationary core shoe, which accepts the core and guides it into the inner tube assembly where the core is retained until transported to the surface for examination.

Conventional core bits are generally comprised of a bit body having a face surface on a bottom end. The opposing end of the core bit is configured, as by threads, for connection to the outer barrel. Located at the center of the face surface is the throat, which extends into a hollow cylindrical cavity formed in the bit body. The face surface includes a plurality of cutters arranged in a selected pattern. The pattern of cutters includes at least one outside gage cutter disposed near the periphery of the face surface that determines the diameter of the bore hole drilled in the formation. The pattern of cutters also includes at least one inside gage cutter disposed near the throat that determines the outside diameter of the core being cut.

During coring operations, a drilling fluid is usually circulated through the core barrel assembly to lubricate and cool the plurality of cutters disposed on the face surface of the core bit and to remove formation cuttings from the bit face surface to be transported upwardly to the surface through the annulus defined between the drill string and the wall of the well bore. A typical drilling fluid, also termed drilling "mud," may be a hydrocarbon or water base in which fine-grained mineral matter is suspended. The core bit includes one or more ports or nozzles positioned to deliver drilling fluid to the face surface. Generally, a port includes a port outlet, or "face discharge outlet," which may optionally comprise a nozzle, at the face surface in fluid communication with a face discharge channel. The face discharge channel extends through the bit body and terminates at a face discharge channel inlet. Each face discharge channel inlet is in fluid communication with an upper annular region formed between the bit body and the inner tube and core shoe. Drilling fluid received from the drill string under pressure is circulated into the upper annular region to the face discharge channel inlet of each face discharge channel to draw drilling fluid from the upper annular region. Drilling fluid then flows through each face discharge channel and discharges at its associated face discharge port to lubricate and cool the plurality of cutters on the face surface and to remove formation cuttings as noted above. Drilling fluid may also be circulated through the through of the coring bit or through other discharge channels, ports, and nozzles that may be provided at the core bit.

Also during the coring operations, debris, generally in the form of formation cuttings separate from the core, may enter the through of the coring bit and may be transported upwardly toward the core shoe. Accordingly, when the core is cut and traverses upwardly through the throat of the coring bit toward the core barrel assembly, the core may push debris between the core catcher and the core shoe. Consequently, the debris in combination with the upward motion of the core may cause a portion of the core catcher to deform such that the core catcher may pass into the inner barrel assembly in which it is intended to retain the core. Such deformation may result in failure of the core catcher and the coring operations.

BRIEF SUMMARY

In some embodiments of the present disclosure, a core catcher for a coring tool comprises a sleeve comprising a longitudinal axis and at least one slit extending at least partially along a height of the sleeve between an upper end and a lower end thereof. The at least one slit separates a first side surface and a second side surface of the sleeve. The first side surface is located a first distance from the longitudinal axis, and the second side surface is located a second distance from the longitudinal axis. Each of the first distance and the second distance is measured in a direction transverse to the longitudinal axis. The core catcher further comprises a bridging element extending at least partially about a perimeter of the sleeve. The bridging element operatively couples movement of the first side surface and the second side surface to limit a difference between the first distance and the second distance as a width of the at least one slit that separates the first side surface and the second side surface increases or decreases.

In other embodiments, a coring tool for extracting a sample of subterranean formation from a wellbore comprises a tube having a central bore configured to receive a sample of the subterranean formation. The coring tool further comprises a core catcher housed within the central bore of the tube. The core catcher comprises a sleeve comprising a longitudinal axis and at least one slit extending at least partially along a height of the sleeve between an upper end and a lower end thereof. The at least one slit separates a first side surface and a second side surface of the sleeve. The first side surface is located a first distance from the longitudinal axis, and the second side surface is located a second distance from the longitudinal axis. Each of the first distance and the second distance is measured in a direction transverse to the longitudinal axis. The core catcher further comprises a bridging element extending at least partially about a perimeter of the sleeve. The bridging element operatively couples movement of the first side surface and the second side surface to limit a difference between the first distance and the second distance as a width of the at least one slit that separates the first side surface and the second side surface increases or decreases.

In yet other embodiments, a method of cutting a core of subterranean formation material from a subterranean formation comprises receiving the core in a core catcher. The core catcher comprises a sleeve comprising a longitudinal axis and at least one slit extending at least partially along a height of the sleeve between an upper end and a lower end thereof. The at least one slit separates a first side surface and a second side surface of the sleeve. The first side surface is located a first distance from the longitudinal axis and the second side surface is located a second distance from the longitudinal axis. Each of the first distance and the second distance is measured in a direction transverse to the longitudinal axis. The core catcher further comprises a bridging element extending at least partially about a perimeter of the sleeve. The method further comprises receiving the core catcher having the core therein within a central bore of a core shoe such that a width of the at least one slit that separates the first side surface and the second side surface is reduced while maintaining a difference between the first distance and the second distance at substantially zero.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

Figure 1:
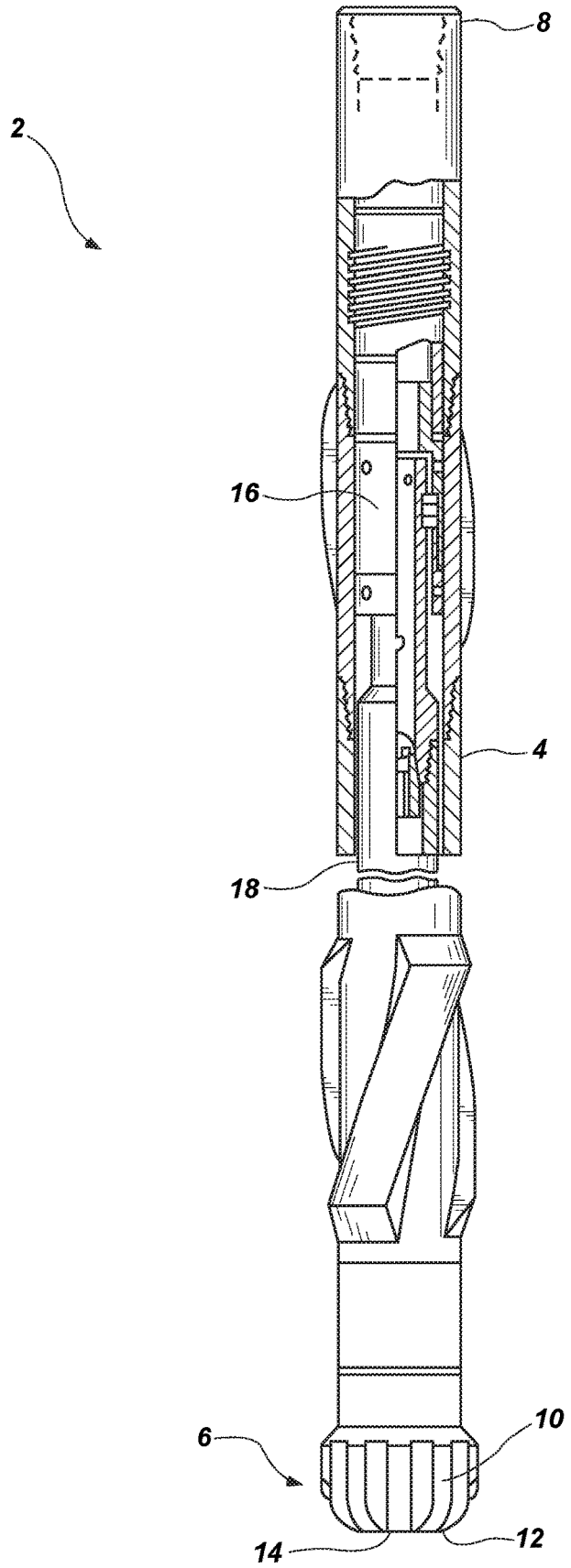
FIG. 1 illustrates a side, partially cut away plan view of a core barrel assembly for cutting a core sample from a subterranean formation.

The illustrations presented herein are not meant to be actual views of any particular coring tool, core catcher, or any component of such coring tools and core catchers, but are merely idealized representations which are employed to describe embodiments of the present disclosure. Additionally, elements common between figures may retain the same numerical designation.

As used herein, directional terms, such as "above", "below", "up", "down", "upward", "downward", "top", "bottom", "upper", "lower", "top-most", "bottom-most," and the like, are to be interpreted from a reference point of the object so described as such object is located in a vertical wellbore, regardless of the actual orientation of the object so described. For example, the terms "above", "up", "upward", "upper", "top", "top-most", and the like, are synonymous with the term "uphole," as such term is understood in the art of subterranean wellbore drilling. Similarly, the terms "below", "down", "lower", "downward", "bottom", "bottom-most", and the like are synonymous with the term "downhole," as such term is understood in the art of subterranean wellbore drilling.

As used herein, the terms "longitudinal", "longitudinally", "axial", or "axially" refers to a direction parallel to a longitudinal axis of the core barrel assembly or the core catcher described herein. For example, "longitudinal" or "axial" movement shall mean movement in a direction substantially parallel to the longitudinal axis of the core barrel assembly or the core catcher described herein.

As used herein, the terms "radial" or "radially" refers to a direction transverse to a longitudinal axis of the core barrel assembly or the core catcher described herein and, more particularly, refers to a direction as it relates to a radius of the core barrel assembly or the core catcher described herein. For example, as described in further detail below, "radial movement" shall mean movement in a direction substantially transverse to the longitudinal axis of the core barrel assembly or the core catcher as described herein.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" in reference to a given parameter is inclusive of the stated value and has the meaning dictated by the context (e.g., it includes the degree of error associated with measurement of the given parameter).

As used herein, the term "and/or" includes any and all combinations of one or more of the associated listed items.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features and methods usable in combination therewith should or must be excluded.

Figure 12:
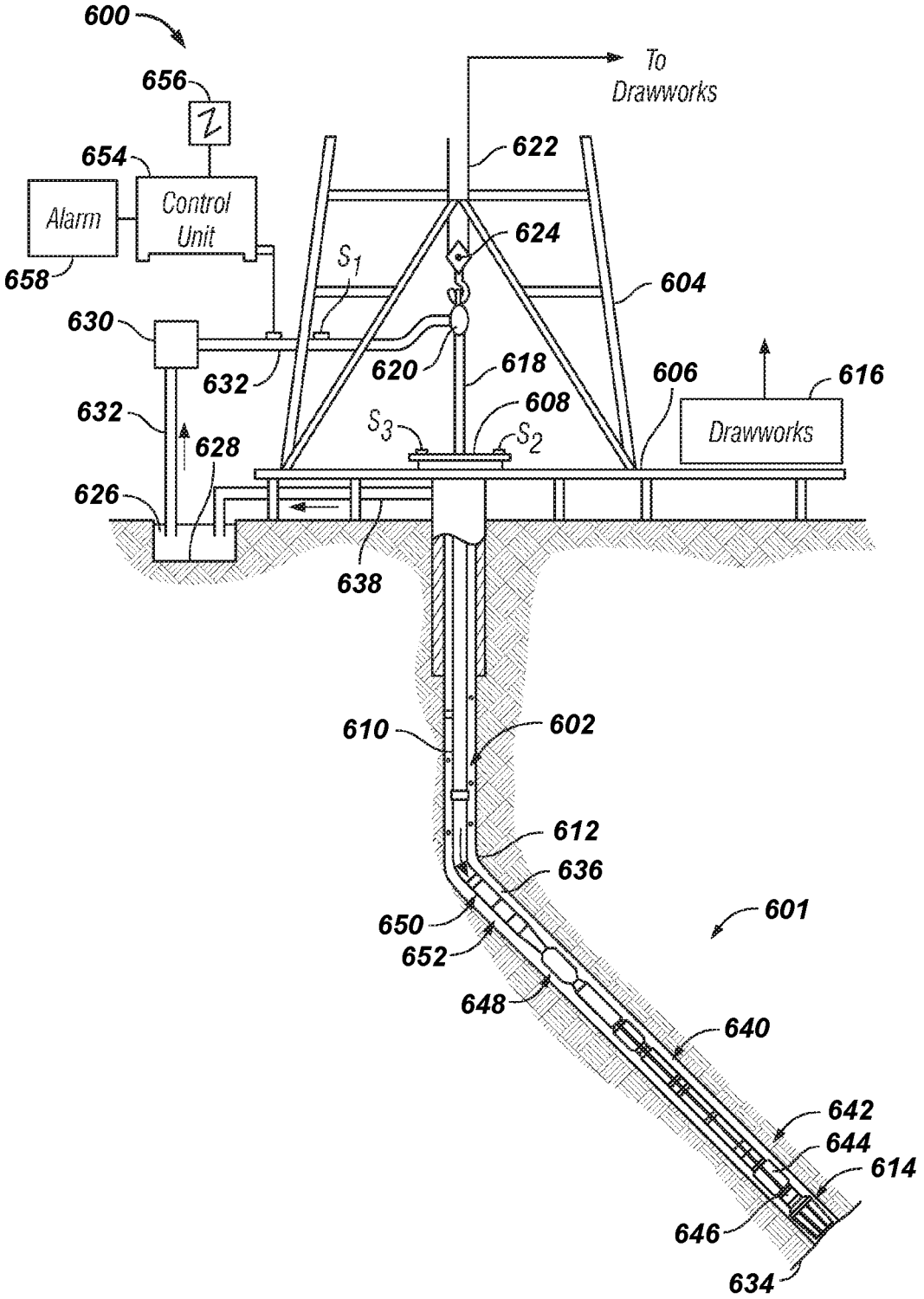
FIG. 12 is a schematic of a drilling system.

FIG. 1 illustrates a core barrel assembly 2. The core barrel assembly 2 may include an outer barrel 4 having a core bit 6 disposed at a bottom end thereof. An upper end 8 of the outer barrel 4 opposite the core bit 6 may be configured for attachment to a drill string (FIG. 12). The core bit 6 includes a bit body 10 having a face surface 12. The face surface 12 of the core bit 6 may define a central opening, or throat 14, that extends into the bit body 10 and is adapted to receive a core (not shown) being cut.

The bit body 10 may comprise steel or a steel alloy, including a maraging steel alloy (i.e., an alloy comprising iron alloyed with nickel and secondary alloying elements such as aluminum, titanium and niobium), and may be formed at least in part as further set forth in U.S. Pat. No. 8,991,471, issued Mar. 31, 2015, to Cheng et al. (hereinafter "Cheng"), the disclosure of which is incorporated herein in its entirety by this reference. In other embodiments, the bit body 10 may be an enhanced metal matrix bit body, such as, for example, a pressed and sintered metal matrix bit body as disclosed in one or more of U.S. Pat. No. 7,776,256, issued Aug. 17, 2010, to Smith et al. and U.S. Pat. No. 7,802,495, issued Sep. 28, 2010, to Oxford et al., the disclosure of each of which is incorporated herein in its entirety by this reference. Such an enhanced metal matrix bit body may comprise hard particles (e.g., ceramics such as oxides, nitrides, carbides, and borides) embedded within a continuous metal alloy matrix phase comprising a relatively high strength metal alloy (e.g., an alloy based on one or more of iron, nickel, cobalt, and titanium). As a non-limiting example, such an enhanced metal matrix bit body may comprise tungsten carbide particles embedded within an iron-, cobalt-, or nickel-based alloy. As a further non-liming example, such an enhanced metal matrix bit body may comprise a ceramic metal composite material including ceramic particles disposed in a continuous metal matrix. However, it is to be appreciated that the bit body 10 may comprise other materials as well, and any bit body material is within the scope of the embodiments disclosed herein, including materials formed by rapid prototyping processes.

Removably disposed inside the outer barrel 4 may be an inner barrel assembly 16. The inner barrel assembly 16 may include an inner tube 18 adapted to receive and retain a core for subsequent transportation to the surface. The inner barrel assembly 16 may further include a core shoe (not shown in FIG. 1) that may be disposed proximate (e.g., close to) the throat 14 for receiving the core and guiding the core into the inner tube 18. The core shoe is discussed in more detail below. The core barrel assembly 2 may include other features not shown or described with reference to FIG. 1, which have been omitted for clarity and ease of understanding. Therefore, it is to be understood that the core barrel assembly 2 may include many features in addition to those shown in FIG. 1.

Figure 2:
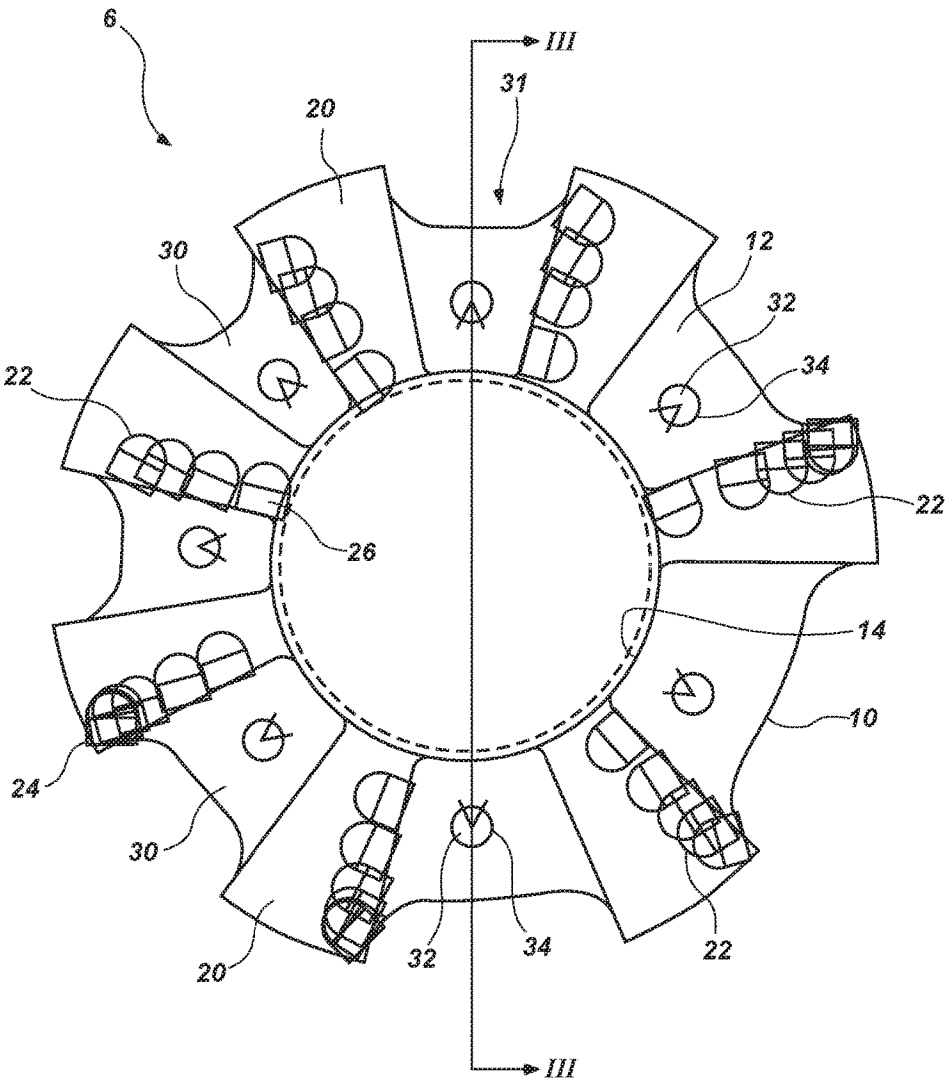
FIG. 2 illustrates a bottom, face view of a core bit of the core barrel assembly of FIG. 1.

FIG. 2 is a bottom view of the core bit 6. As can be seen in FIG. 2, the throat 14 may open into the bit body 10 at the face surface 12. The bit body 10 may include a plurality of blades 20 at the face surface 12. A plurality of cutters 22 may be attached to the blades 20 and arranged in a selected pattern. The pattern of cutters 22 (shown longitudinally and rotationally superimposed one upon another along the bit profile in FIG. 2 and FIG. 3, respectively) may include at least one outside gage cutter 24 that determines the diameter of the bore hole cut in the formation. The pattern of cutters 22 may also include at least one inside gage cutter 26 that determines the diameter of the core 28 (shown by the dashed line, FIG. 3) being cut and entering the throat 14. Radially extending fluid passages 30 may be formed on the face surface 12 between successive blades 20, which fluid passages 30 are contiguous with associated junk slots 31 on the gage of the core bit 6 between the blades 20. The face surfaces of the fluid passages 30 may be recessed relative to the blades 20. The bit body 10 may further include one or more face discharge outlets 32 for delivering drilling fluid to the face surface 12 to lubricate the cutters 22 during a coring operation. The bit body 10 may further include additional fluid passages and discharge outlets for delivering drilling fluid at the core bit 6 to, for example, circulate fluid through the inner tube 18, to flush the inner tube 18, and/or to clean the bottom of the borehole.

Figure 3:
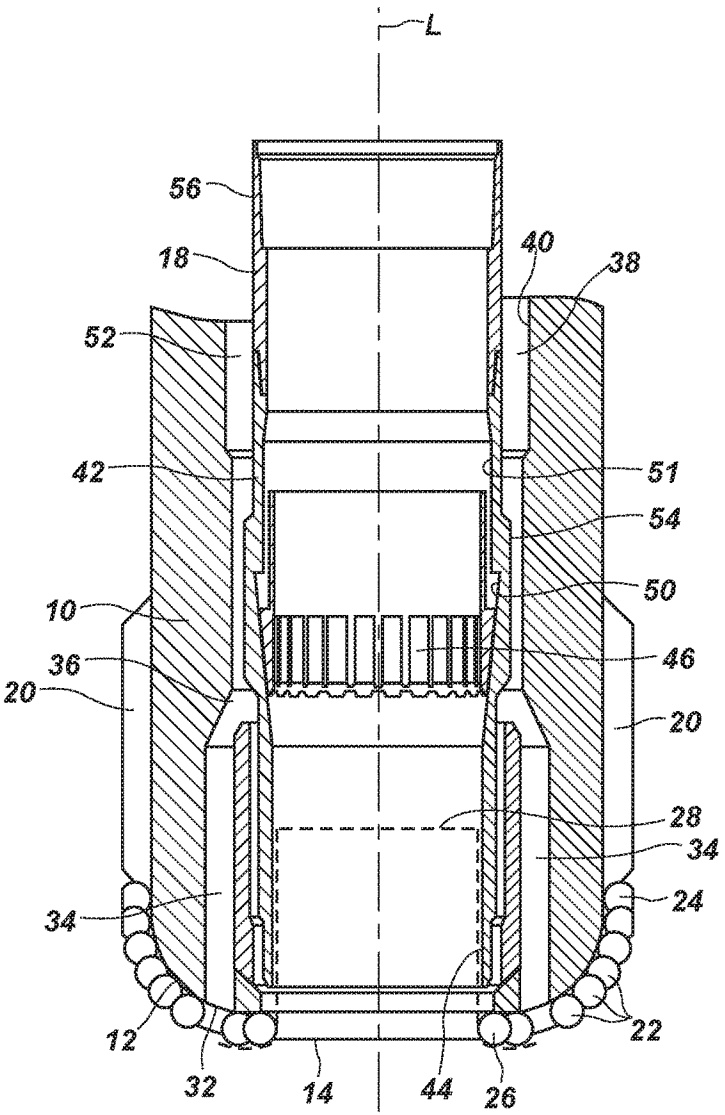
FIG. 3 illustrates a longitudinal cross-sectional view of the core bit and associated core shoe of FIGS. 1 and 2, taken along line of FIG. 2.

Referring to FIG. 3, each face discharge outlet 32 is in fluid communication with a face discharge channel 34 extending from the face discharge outlet 32 through the bit body 10 and inwardly terminating at a face discharge channel inlet 36. The bit body 10 may at least partially define or limit one or more face discharge channels 34 extending through the bit body 10 from associated face discharge channel inlets 36 to associated face discharge outlets 32 at the face surface 12 of the bit body 10. The face discharge channels 34 may be circumferentially spaced. The bit body 10 may have an inner cavity 38 extending longitudinally therethrough and bounded by an inner surface 40 of the bit body 10. The inner cavity 38 may optionally be substantially cylindrical. The throat 14 opens into the inner cavity 38. At least a portion of at least one of the face discharge channels 34 may be defined or limited by at least a portion of the inner surface 40 of the bit body 10. The inner tube 18 may extend into the inner cavity 38 of the bit body 10. A core shoe 42 may be disposed at the lower end of the inner tube 18 and may be at least partially disposed within at least a portion of the bit body 10. As shown, the core shoe 42 may be a separate body coupled to the inner tube 18. However, in other embodiments, the core shoe 42 and the inner tube 18 may be integrally formed together. The inner tube 18 and the core shoe 42 may each be in the form of a tubular body, and each may be suspended so that the core bit 6 and the outer barrel 4 may substantially freely rotate about the inner tube 18 and the core shoe 42. The core shoe 42 may have a central bore 44 configured and located to receive the core 28 therein as the core 28 traverses the throat 14 and to guide the core 28 into the inner tube 18. The core shoe 42 may be hardfaced to increase its durability.

A core catcher 46 may be carried by the core shoe 42 and may be housed within the central bore 44 of the core shoe 42. The core catcher 46 may be sized and shaped to enable the core 28 to pass through the core catcher 46 when traveling longitudinally upward into the inner tube 18. When the core barrel assembly 2 begins to back out of the well bore, the core 28 may travel longitudinally downward toward the bottom of the borehole due to gravity, due to friction with the borehole, or due to maintain connection of the core 28 with the formation from which it is intended to be removed. The core catcher 46 travels longitudinally downward with the core 28. Further, a portion of the outer surface of the core catcher 46 may interact with a tapered portion 50 of an inner surface 51 of the core shoe 42 to cause the core catcher 46 to constrict around and frictionally engage with the core 28, reducing (e.g., eliminating) the likelihood that the core 28 will exit the inner tube 18 after it has entered therein and enabling the core 28 to be fractured under tension from the formation from which the core 28 has been cut, as the core barrel assembly 2 is lifted away from the bottom of the borehole by the operator. The core 28 may then be retained in the inner tube 18 until the core 28 is transported to the surface for analysis.

An annular space 52 within the core barrel assembly 2 is located between the inner surface 40 of the bit body 10 and outer surfaces 54, 56 of the core shoe 42 and the inner tube 18, respectively. The annular space 52 forms a drilling fluid flow path extending longitudinally through the core barrel assembly 2 from a proximal end of the bit body 10 to the face discharge channel inlets 36. During a coring operation, drilling fluid is circulated under pressure into the annular space 52 such that drilling fluid can flow therefrom to the face surface 12 of the core bit 6.

Figure 4A:
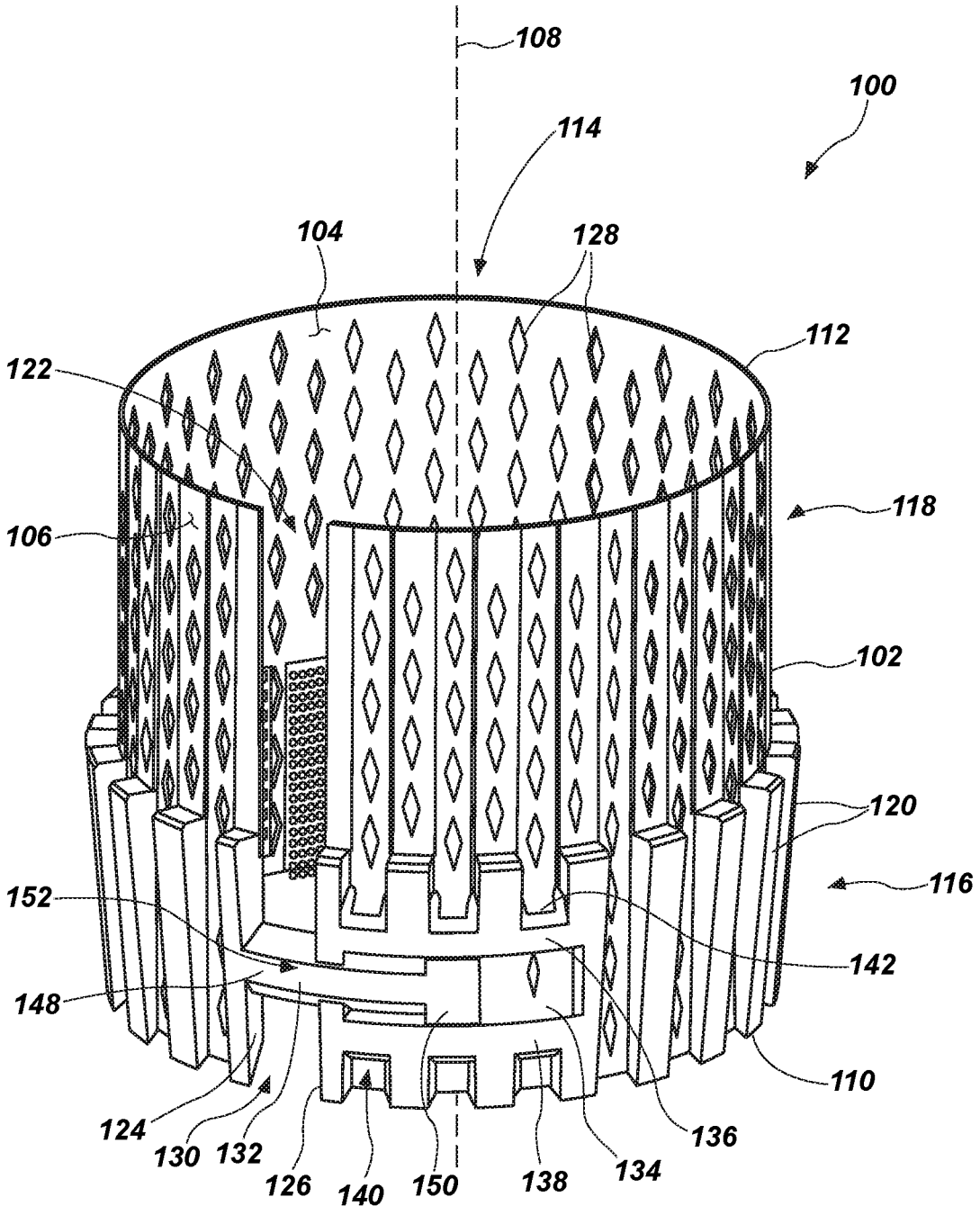
FIGS. 4A-4D illustrate a perspective view, a cross-sectional view, a partial, magnified cross-sectional view, and a top view respectively, of a core catcher according to an embodiment of the present disclosure.
Figure 4B:
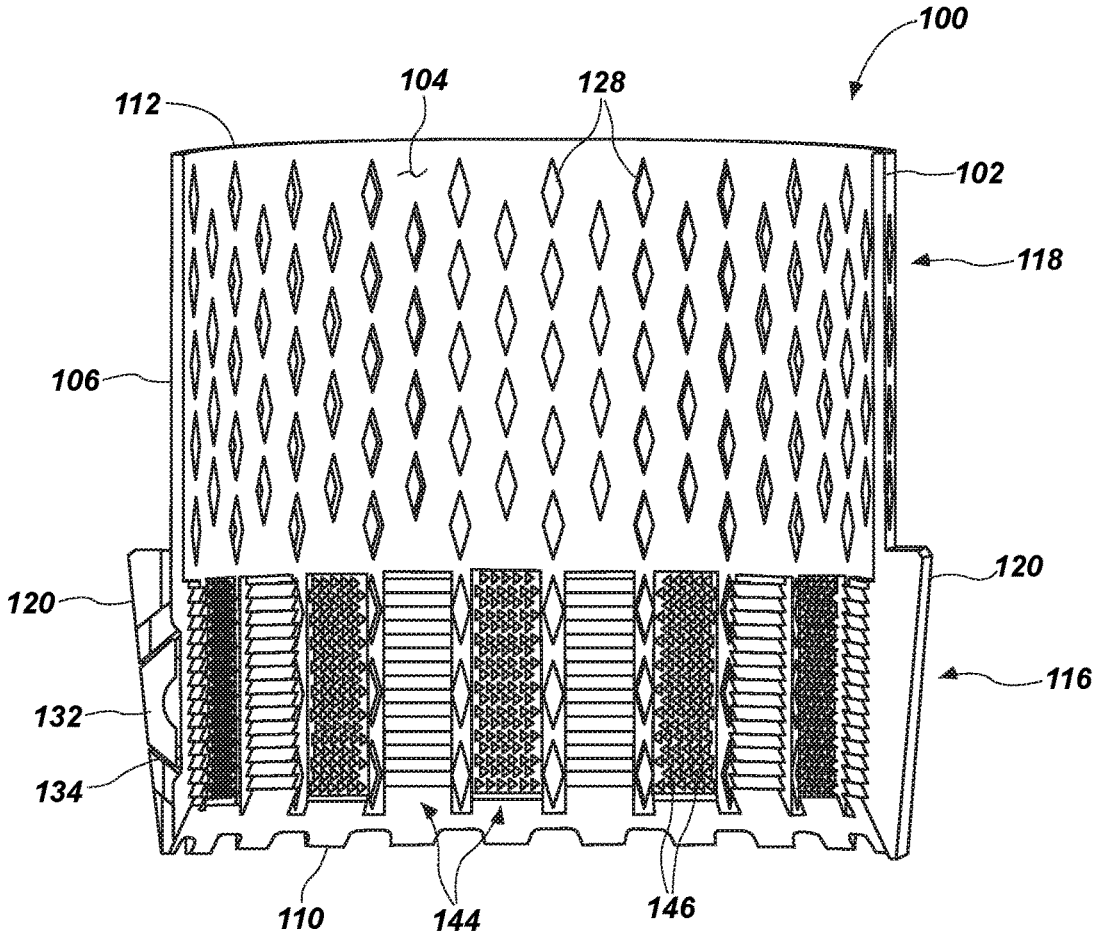
Figure 4C:
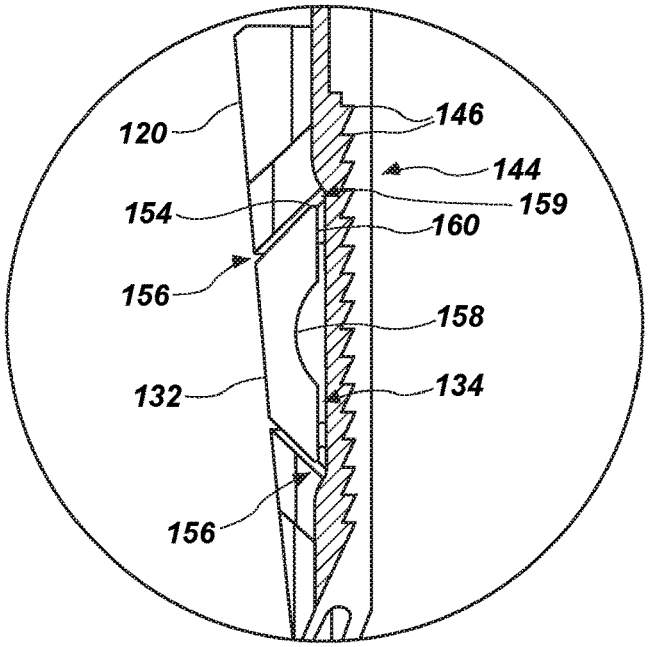

FIGS. 4A-C illustrate a perspective view, a cross-sectional view, and an enlarged cross-sectional view, respectively, of a core catcher 100 according to embodiments of the present disclosure. The core catcher 100 may comprise a sleeve 102 having an inner surface 104 and an outer surface 106 extending along a longitudinal axis 108 between a lower (e.g., downhole) end 110 and upper (e.g., uphole) end 112 thereof. As illustrated herein, the core catcher 100 may be generally cylindrical in shape. However, the present disclosure is not so limited and may have any other shape including, but not limited to, a generally elliptical shape. A distance between the inner surface 104 and the outer surface 106 may define a thickness $T_{102}$ (FIG. 4D) of the sleeve 102. The thickness $T_{102}$ (FIG. 4D) of the sleeve 102 may vary along a height (e.g., dimension measured in axial direction) of the core catcher 100 and/or about a circumference of the sleeve 102. The inner surface 104 defines an aperture 114, which may be sized and shaped to enable the core 28 to pass through the core catcher 100 when traveling longitudinally upward into the inner tube 18. The outer surface 106 may comprise a conical portion 116 proximate to the lower end 110 and a cylindrical portion 118, which may be referred to in the art as a "skirt", proximate to the upper end 112 of the sleeve 102. The conical portion 116 may comprise a plurality of wedge-shaped radially protruding and longitudinally extending projections 120 circumferentially spaced about the core catcher 100.

The sleeve 102 may comprise at least one opening or slit 122 extending at least partially along the height of the core catcher 100 between the lower end 110 and the upper end 112. In some embodiments, as illustrated in FIG. 4A, a height of the slit 122 may be coextensive with a height of the core catcher 100 such that the slit 122 extends from the lower end 110 to the upper end 112. In other embodiments, the slit 122 may extend partially along the height of the core catcher 100 such that the slit may extend, for example, within the cylindrical portion 118 of the sleeve and not the conical portion 116 or vice versa. The slit 122 may be defined or bordered by opposing first and second side surfaces 124, 126 of the sleeve 102. The first and second side surfaces 124, 126 may extend radially between the inner surface 104 and the outer surface 106 of the sleeve 102 and may extend axially at least partially along the height of the sleeve 102 between the lower end 110 and the upper end 112.

The inner surface 104 of the sleeve 102 frictionally engages and grips the core 28 as it passes through the aperture 114 of the sleeve 102. In some embodiments, the inner surface 104 of the sleeve 102 may be substantially even or smooth. In other embodiments, the inner surface 104 of the sleeve 102 may comprise one or more patterned surfaces 144 as illustrated in the cross-sectional view of FIG. 4B. The patterned surface 144 may extend axially at least partially along the height of the sleeve 102 between the lower end 110 and the upper end 112. The patterned surface 144 may also extend at least partially about the circumference of the inner surface 104 of the sleeve 102. In some embodiments, the patterned surface 144 may be provided within the conical portion 116 proximate to the lower end 110 of the sleeve 102. In some embodiments, the patterned surface 144 may comprise a plurality of discrete, patterned surfaces.

Each patterned surface 144 may be comprised of a plurality of raised structures 146. In some embodiments, the raised structures 146 may be ordered or uniformly organized. In other embodiments, the raised structures 146 may be randomly organized. The patterned surfaces 144 may have a plurality of different shaped raised structures 146. For example, the raised structures 146 may comprise polyhedrons having a sharp or pointed apex, such as the pyramid structures illustrated in FIG. 4B, waveform structures having a sharp or pointed ridge, such as the sawtooth structures also illustrated in FIG. 4B, or any other shape having a sharp or pointed edge or tip configured to provide a textured or rough surface to frictionally engage or grip the core 28 as it passes through the aperture 114 of the sleeve 102. In some embodiments, the inner surface 104 of the sleeve, including but not limited to the patterned surfaces 144, may be coated with a hardfacing material or heat treated for increased durability.

The sleeve 102 may optionally comprise a plurality of openings 128. The openings 128 may extend radially between the inner surface 104 and the outer surface 106 of the sleeve 102. The openings 128 may be spaced circumferentially about the sleeve 102 and axially along the height of the sleeve 102. In FIGS. 4A-4C, the openings 128 are illustrated as having a diamond shape; however, the shape of the openings 128 is not so limited and the openings 128 may have any other shape. The openings 128 may be formed to provide fluid flow between the inner surface 104 and outer surface 106 of the sleeve 102, as explained in further detail below. The openings 128 may also be formed to reduce rigidity and increase flexibility of the sleeve 102. In other embodiments, rigidity of the sleeve 102 may be decreased and flexibility of the sleeve 102 may be increased by providing regions of reduced wall thickness in place of the openings 128, such that the inner surface 104 and/or outer surface 106 of the sleeve 102 may be dimpled. In yet other embodiments, rigidity of the sleeve 102 may be decreased and flexibility of the sleeve 102 may be increased by providing a material having different material properties within spaces of the openings 128, such as having decreased rigidity or increased flexibility, relative to the material of the remainder of the sleeve 102.

The core catcher 100 may comprise a bridging element 130. The bridging element 130 may be configured to couple radial movement and/or axial movement of portions of the sleeve 102 about the circumference (e.g., perimeter) thereof. In other words, the bridging element 130 is configured to impede independent radial and/or axial movement of portions of the sleeve 102 and, more particularly, independent radial and axial movement of portions of the sleeve 102 adjacent to the slit 122 as described in further detail with respect to FIG. 4D. By way of example and not limitation, without the bridging element 130, the sleeve 102 may deform such that portions of the sleeve 102 adjacent to the first side surface 124 extend axially upward or downward relative to portions of the sleeve 102 adjacent to the second side surface 126. Alternatively or additionally, the sleeve 102 may deform such that portions of the sleeve 102 adjacent to the first side surface 124 extend radially inward or outward relative to portion of the sleeve 102 adjacent to the second side surface 126. By way of example and not limitation, without the bridging element 130, the core catcher 100 may be caused to deform such that the inner surface 104 overlaps with and contacts the outer surface 106. Such deformation of the sleeve 102 may prevent or inhibit movement of the core 28 through the core catcher 100, may prevent the core catcher 100 from constricting around and frictionally engaging with the core 28 resulting in loss of the core 28 cut by the core bit 6, or otherwise resulting in failure of the core catcher 100.

In some embodiments, the bridging element 130 may comprise a crosspiece 132 and a track 134. The crosspiece 132 may comprise a rigid element (e.g., element having a fixed length) configured to slide along the track 134 as the diameter of the core catcher 100 increases and decreases as previously described. The track 134 may be formed on a side of the slit 122 opposite the side of the slit 122 on which the crosspiece 132 is formed. The crosspiece 132 may extend at least partially about the circumference of the outer surface 106 of the sleeve 102 such that the crosspiece 132 extends across the slit 122 and into the track 134. The track 134 may also extend at least partially about the circumference of the outer surface 106 of the sleeve 102.

As illustrated in FIGS. 4A-4C, the crosspiece 132 and track 134 may be formed within the conical portion 116 of the sleeve 102. In other embodiments, the crosspiece 132 and track 134 may be located alternatively or additionally about the cylindrical portion 118 of the sleeve 102. In the embodiment illustrated in FIGS. 4A-4C, the track 134 may be formed by a plurality of the wedge-shaped projections 120 interconnected by upper and lower projections 136, 138 extending between respective wedge-shaped projections 120 and by recesses formed in each of the interconnected wedge-shaped projections 120. In some embodiments, a fluid channel 140 may optionally be provided above and/or below the track 134. The fluid channel 140 may comprise an aperture defined by the outer surface 106 of the sleeve 102 and an inner surface 142 of the projections 136, 138. As will be explained in further detail below, the fluid channel 140 may be sized and configured to provide fluid flow to the bridging element 130 and, more particular, to provide fluid flow within the track 134 such that any debris present in the track 134 may be removed.

The crosspiece 132 is operatively connected to the sleeve 102. In some embodiments, at least a portion of the crosspiece 132 may be coupled (e.g., fixed) to or formed integral with the sleeve 102. The crosspiece 132 may be mechanically fixed to the sleeve 102 such as by screws, clamps, welding, brazing, and the like and/or may be adhesively fixed to the sleeve 102 such as by glue and the like. As illustrated in FIG. 4A, a first circumferential end 148 may be attached to the first side surface 124 of the sleeve 102. The crosspiece 132 may be unfixed or slidably engaged (e.g., movable) with the track 134 at a second circumferential end 150 opposite the first end 148. In other words, the crosspiece 132 may be cantilevered as it extends at least partially across the slit 122. In some embodiments, the crosspiece 132 may vary in height along a length (e.g., dimension measured about the circumference of the sleeve 102) thereof between the first end 148 and the second end 150. For instance, the crosspiece 132 may have a lesser height proximate to the first end 148 and along at least a portion of the length of the crosspiece 132 that extends through an entrance 152 of the track 134 compared to the height of the crosspiece 132 proximate to the second end 150. The height of the crosspiece 132 proximate the second end 150 may be sufficient to retain the second end 150 within the track 134 and to prevent the second end 150 of the crosspiece 132 from passing through the entrance 152 of the track 134. For example, as illustrated in FIG. 4A, the second end 150 of the crosspiece 132 may have a hammerhead shape; however, the shape of the second end 150 is not so limited and the second end 150 may have any other shape that retains the second end 150 in the track 134. In other embodiments, the crosspiece 132 may comprise any other element to retain the crosspiece 132 within the track 134 including a stop, block, catch, mechanical arrestor, or dog. In yet other embodiments, the crosspiece 132 may have a variable radial thickness between the first end 148 and the second end 150 such that the thickness of crosspiece 132 proximate the second end 150 is greater than a size of the entrance 152 of the track 134 to prevent the second end 150 of the crosspiece 132 from passing through the entrance 152 of the track 134. Variable radial thickness may further impart variable mechanical properties to the crosspiece 132 including, but not limited to, stiffness, rigidity, and flexibility. Furthermore, the crosspiece 132 may comprise recesses or openings formed therethrough to increase flexibility and decrease rigidity of the crosspiece 132.

With reference to the enlarged cross-sectional view of FIG. 4C, the crosspiece 132 includes track engagement features that may be configured to engage complementary crosspiece engagement features. For example, the crosspiece 132 may include integral projections 154 that extend axially into complementary recesses 156 of the track 134. The engagement of the projections 154 of the crosspiece 132 with the complementary recesses 156 of the track 134 retains the crosspiece 132 within the track 134. As shown in FIG. 4C, the complementary surfaces of the crosspiece 132 and track 134 at the interface therebetween may have a wedge shape; however, the shape of the complementary surfaces of the crosspiece 132 and track 134 is not so limited and the complementary surfaces may have any other complementary shape that retains the crosspiece 132 within the track 134. In some embodiments, the complementary surfaces of the crosspiece 132 and track 134 may be flush with (e.g., in contact with) each other. In other embodiments, the complementary surfaces of the crosspiece 132 and the track 134 may be sized and shaped to provide an opening 159 therebetween.

With continued reference to FIG. 4C, the crosspiece 132 may comprise at least one recess 158 formed in an inner surface 160 thereof. The recess 158 may extend at least partially along the length of the crosspiece 132 between the first end 148 and second end 150 thereof and/or at least partially along a height of the crosspiece 132. The recess 158 may be sized and configured to provide fluid flow between the crosspiece 132 and track 134. While the recess 158 is illustrated in FIG. 4C as having a semicircular or curved shape, the recess 158 is not so limited and may have any other shape including curved and/or angled edges and surfaces.

In operation, fluid flow may be provided between the crosspiece 132 and the track 134 through one or more of the openings 128 in the sleeve 102 and the fluid channel 140 (FIG. 4A) located above and below the track 134. Fluid may also flow between the complementary surfaces of the crosspieces 132 and the track 134 such as within the opening 159 therebetween. Fluid flow may be also provided between the inner surface 160 of the crosspiece 132 and the track 134 within the recess 158. Fluid flow may be provided between the crosspiece 132 and the track 134 to clear debris from cuttings of the core bit 6 and from the core 28, which may become lodged in the track 134 and inhibit movement of the crosspiece 132 along the track 134.

Figure 4D:
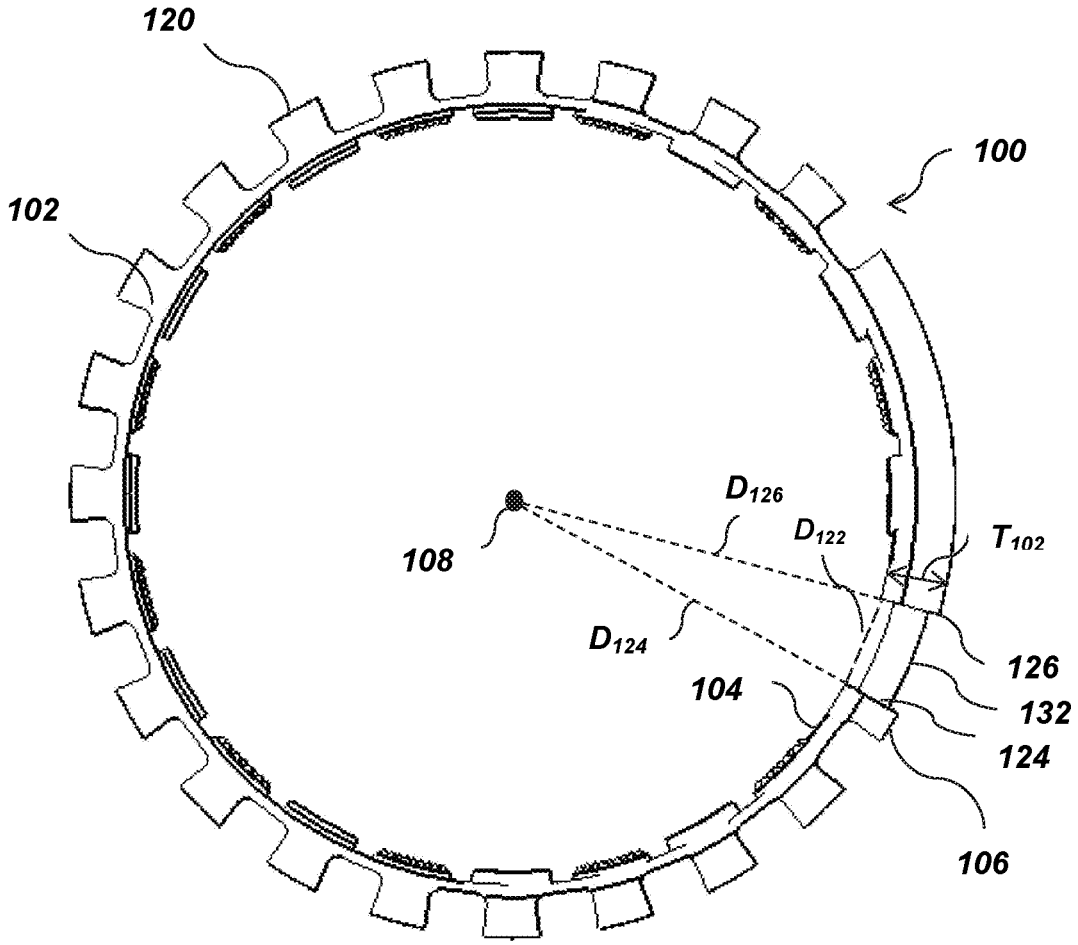

As described in further detail below, the bridging element 130 extends across the slit 122 to operatively connect the first side surface 124 and the second side surface 126. FIG. 4D is a top view of the core catcher 100. During operation of the core barrel assembly 2 (FIG. 1) to extract a core of subterranean formation material, the core catcher 100 may be carried by the core shoe 42 and may be housed within the central bore 44 of the core shoe 42 (FIG. 3). The one or more wedge-shaped projections 120 (FIG. 4A) may freely move along the tapered portion 50 of the core shoe 42 (FIG. 3). The core bit 6 may cut a core 28 (FIGS. 2 and 3) of subterranean formation material, and the core 28 may be received in the core catcher 100. As the core catcher 100 moves longitudinally within the tapered portion 50 of the core shoe 42 with the core received therein, the core catcher 100 may increase and decrease in diameter and circumference. More particularly, as the core catcher 100 moves longitudinally within the tapered portion 50 of the core shoe 42, a width $D_{122}$ of the slit 122, which is measured between the first and second side surface 124, 126, may increase and decrease allowing the diameter and the circumference of the sleeve 102 to increase and decrease accordingly. As the width $D_{122}$ of the slit 122 increases and decreases, the bridging element 130 operatively couples movement of the first side surface 124 and the second side surface 126. More particularly, the bridging element 130 limits a difference between a first distance $D_{124}$, or a distance measured between the longitudinal axis 108 and a point at which the inner surface 104 of the sleeve 102 meets (e.g., intersects) the first side surface 124, and a second distance $D_{126}$, or a distance measured between the longitudinal axis 108 and a point at which the inner surface 104 of the sleeve 102 meets the second side surface 126. Each of the first distance $D_{124}$ and the second distance $D_{126}$ is measured in a direction transverse to the longitudinal axis 108. More particularly, the first distance $D_{124}$ and the second distance $D_{126}$ may be measured in a direction perpendicular to the longitudinal axis 108. Accordingly, the bridging element 130 operatively couples radial and/or axial movement of the first side surface 124 and the second side surface 126 such that the first distance $D_{124}$ and the second distance $D_{126}$ may remain substantially equal (e.g., a difference of between the first distance $D_{124}$ and the second distance $D_{126}$ being substantially zero) to each other as the width $D_{122}$ of the slit 122 increases and decreases with movement of the core catcher 100 in the core shoe 42. As previously described herein, without the bridging element 130, the core catcher 100 may be caused to deform such that the inner surface 104 overlaps with and contacts the outer surface 106. Accordingly, as the width $D_{122}$ increases and decreases, the bridging element 130 prevents such overlapping of the first side surface 124 and the second side surface 126 such that the difference between the first distance $D_{124}$ and the second distance $D_{126}$ is less than a thickness $T_{102}$ of the sleeve 102, or a distance measured between the inner surface 104 and the outer surface 106 of the sleeve 102, and may be measured at a location at which the bridging element 130 is provided. Put differently, the thickness $T_{102}$ of the sleeve 102 is the difference between an inner diameter and an outer diameter of the sleeve 102. More particularly, the difference between the first distance $D_{124}$ and the second distance $D_{126}$ may be less than a maximum thickness of the conical portion 116 of the core catcher 100. For example, the difference between the first distance $D_{124}$ and the second distance $D_{126}$ may be less than about 7 mm, less than about 4 mm, or less than about 1 mm or may extend in a range from about 5 mm to about 7 mm, from about 2 mm to about 4 mm, or between about 1 mm and 2 mm.

Figure 5B:
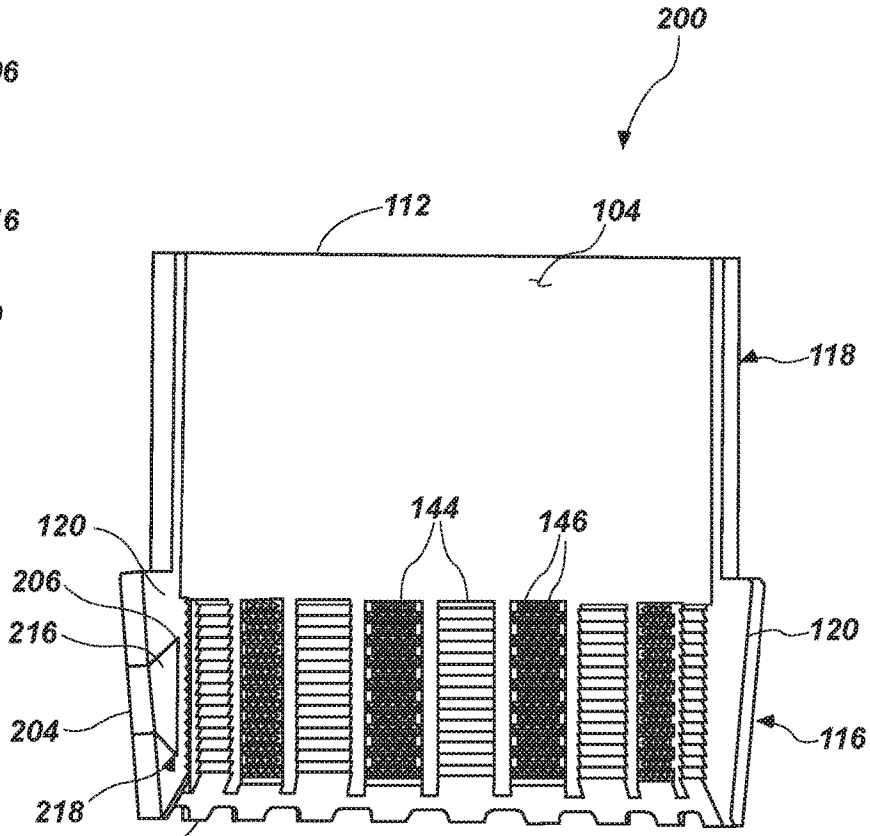
FIGS. 5A and 5B illustrate a perspective view and a cross-sectional view of a core catcher according to additional embodiments of the present disclosure.
Figure 5A:
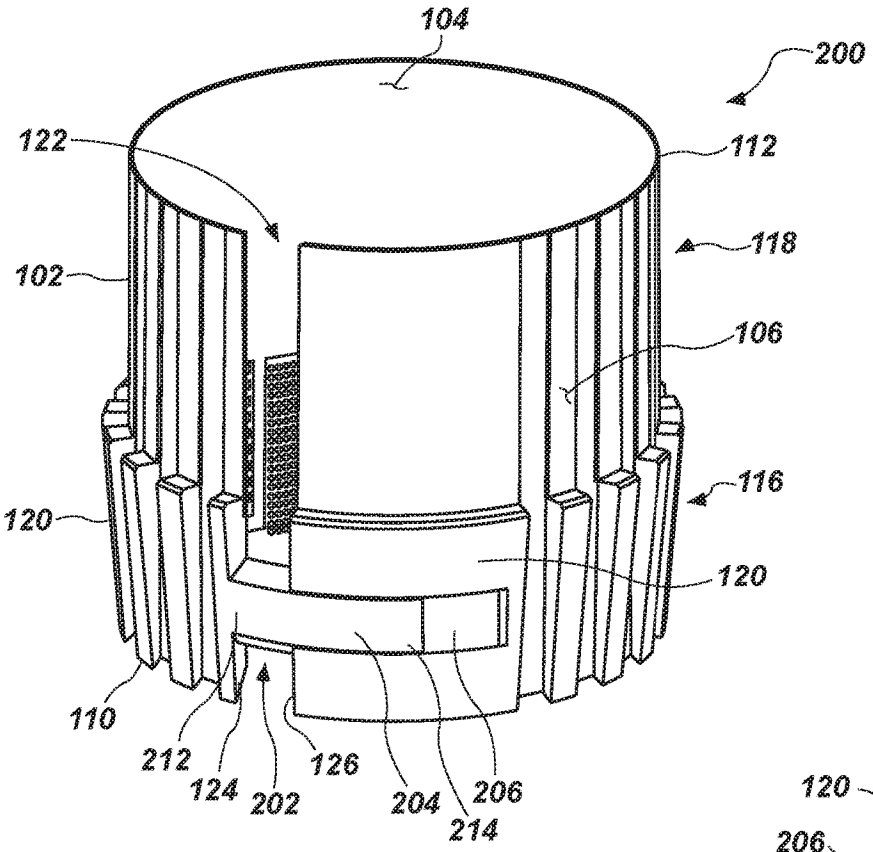

FIGS. 5A and 5B illustrate a perspective view and a cross-sectional view of a core catcher 200 according to additional embodiments of the present disclosure. Like the core catcher 100, the core catcher 200 includes a slit 122 extending at least partially along the height of the sleeve 102 between the lower end 110 and the upper end 112 and includes a bridging element 202. The bridging element 202 may comprise a crosspiece 204 and a track 206. As illustrated in FIG. 5A, the crosspiece 204 and track 206 may be formed within the conical portion 116 of the sleeve 102. In other embodiments, the crosspiece 204 and track 206 may be located alternatively or additionally about the cylindrical portion 118 of the sleeve 102. The crosspiece 204 may extend at least partially about the circumference of the sleeve 102, across the slit 122, and into the track 206. The track 206 may also extend at least partially about the circumference of the sleeve 102. The track 206 may be formed by a recess in an elongated wedge-shaped projection 120. The track 206 may be formed on a side of the slit 122 opposite the side of the slit 122 on which the crosspiece 204 is formed.

Like the crosspiece 132, at least a portion of the crosspiece 204 may be coupled to or formed integral with the sleeve 102. For example, as illustrated in FIG. 5A, a first circumferential end 212 of the crosspiece 204 may be attached to the first side surface 124 of the sleeve 102. The crosspiece 204 may be slidably engaged with the track 206 at a second circumferential end 214 opposite the first end 212. Unlike the crosspiece 132, the crosspiece 204 may have a substantially uniform height along the length thereof between the first and second ends 212, 214. The track 206 may also have a substantially uniform height along a length thereof.

With reference to the cross-sectional view of FIG. 5B, the crosspiece 204 includes track engagement features that may be configured to engage complementary crosspiece engagement features. For example, the crosspieces 204 may include integral projections 216 that extend axially into complementary recesses 218 of the track 206. The crosspiece 204 is retained within and configured to move within the track 206 as the diameter of the core catcher 200 increases and decreases. As shown in FIG. 5B, the complementary surfaces of the crosspiece 204 and the track 206 at the interface therebetween may have a wedge shape; however, the shape of the complementary surfaces is not so limited and the complementary surfaces of the crosspiece 204 and the track 206 may have any other shape.

Figure 6:
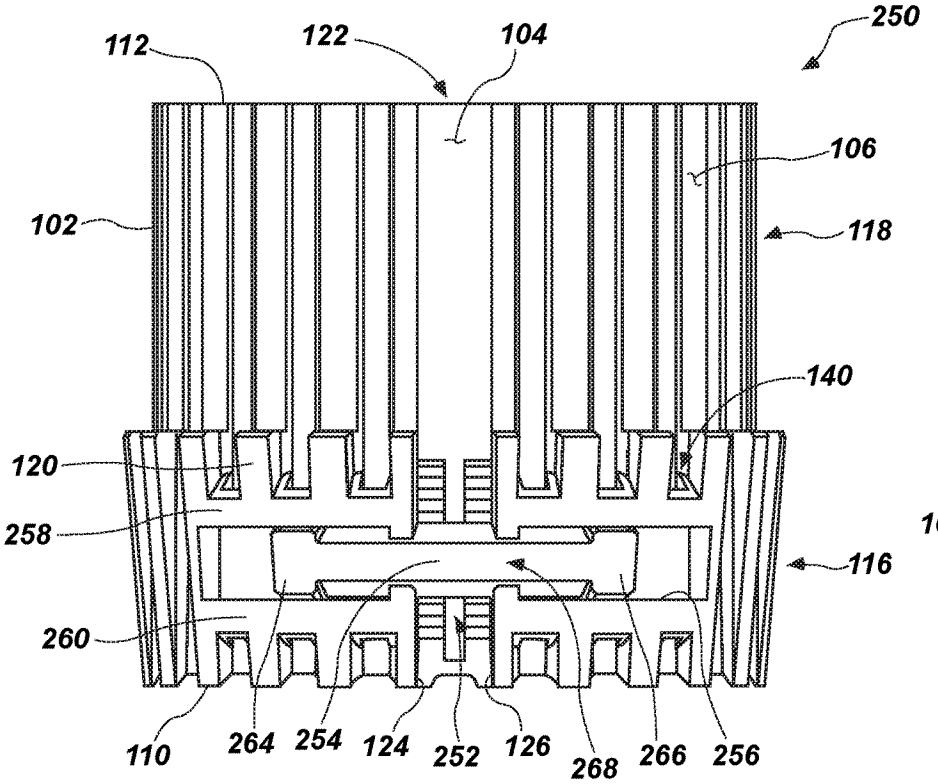
FIG. 6 illustrates a side view of a core catcher according to another embodiment of the present disclosure.

FIG. 6 illustrates a side view of a core catcher 250 according to another embodiment of the present disclosure. The core catcher 250 includes a slit 122 extending at least partially along the height of the core catcher 250 between the lower end 110 and the upper end 112 and a bridging element 252. The bridging element 252 may comprise a crosspiece 254 extending at least partially about the circumference of the sleeve 102, across the slit 122, and into the track 256, which also extends at least partially about the circumference of the sleeve 102. In some embodiments, the track 256 may be formed by a plurality of wedge-shaped projections 120 interconnected by upper and lower projections 258, 260 and by recesses formed in the wedge-shaped projections 120, as previously described with reference to FIGS. 4A-4C. In other embodiments, the track 256 may be formed by an elongated wedge-shaped projection, as previously described with reference to FIGS. 5A and 5B.

The track 256 may be formed adjacent or proximate to each side of the slit 122 such that the track 256 extends at least partially about the circumference of the sleeve 102 adjacent to the first side surface 124 and adjacent to the second side surface 126. Unlike the crosspiece 132 of FIGS. 4A-4C and the crosspiece 204 of FGS. 5A and 5B, the crosspiece 254 may be unfixed from the sleeve 102 and slidably engaged with the track 256 at a first circumferential end 264 and a second circumferential end 266 opposite the first end 264. Accordingly, the crosspiece 254 may be movable relative to each of the first and second side surfaces 124, 126 of the sleeve 102. As illustrated in FIG. 6, the crosspiece 254 and the track 256 have shapes similar to the crosspiece 132 and track 134 of FIGS. 4A-4C such that a height of the crosspiece 254 varies along a length thereof between the first and second ends 264, 266 and such that the track 256 includes a narrowed entrance 268 adjacent to the first and second side surfaces 124, 126, respectively. For example, the height of the crosspiece 254 may be greatest at the respective first and second ends 264, 266 and may be sufficient to retain the first and second ends 264, 266 within the track 256 and prevent the first and second ends 264, 266 from passing through the narrowed entrance 268 of each portion of the track 256. In other embodiments, the crosspiece 254 and the track 256 may have shapes similar to the crosspiece 254 and the track 256 of FIGS. 5A and 5B such that the crosspiece 254 and the track 256 have substantially uniform heights along the respective lengths thereof.

As previously described herein with regards to the embodiments of FIGS. 4A-4C, 5A, and 5B, the crosspiece 254 includes track engagement features that may be configured to engage complementary crosspiece engagement features. For example, the crosspiece 254 may include integral projections (not shown) that extend axially into complementary recesses (not shown) of the track 256. The crosspiece 254 is configured to move within the track 256 as the diameter of the core catcher 250 increases and decreases. The complementary surfaces of the crosspiece 254 and the track 256 at the interface therebetween may have a wedge shape as previously illustrated in FIGS. 4C and 5B; however, the shape of the complementary surfaces is not so limited and the complementary surfaces of the crosspiece 254 and the track 256 may have any other shape.

Figure 7A:
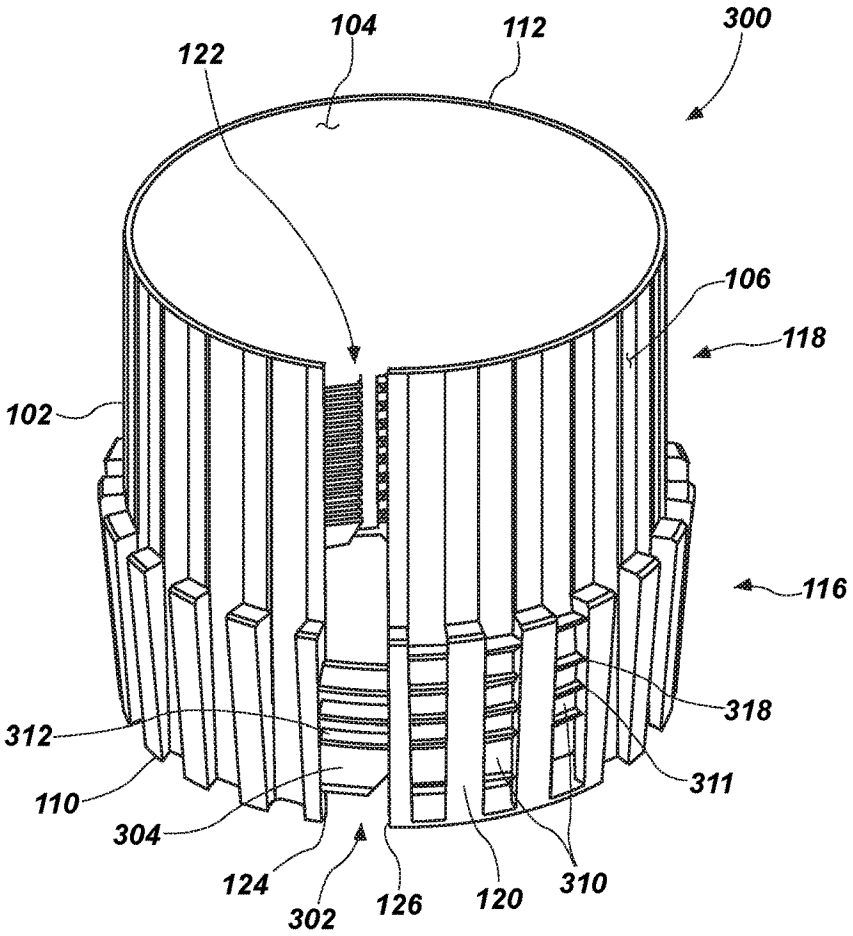
FIGS. 7A-7C illustrate a perspective view, a cross-sectional view, and an enlarged cross-sectional view, respectively, of a core catcher according to other embodiments of the present disclosure.
Figure 7C:
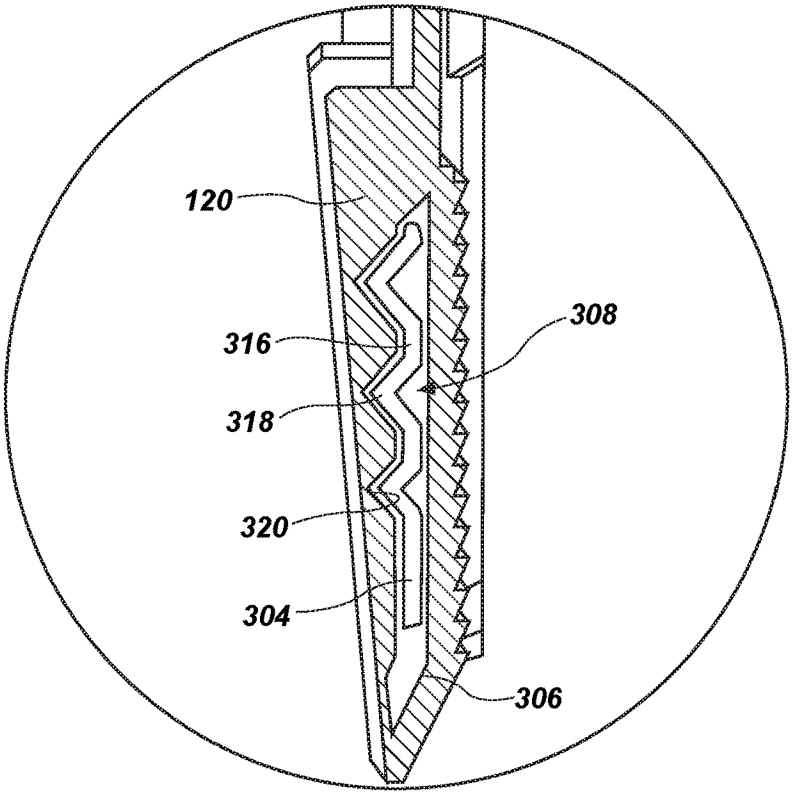
Figure 7B:
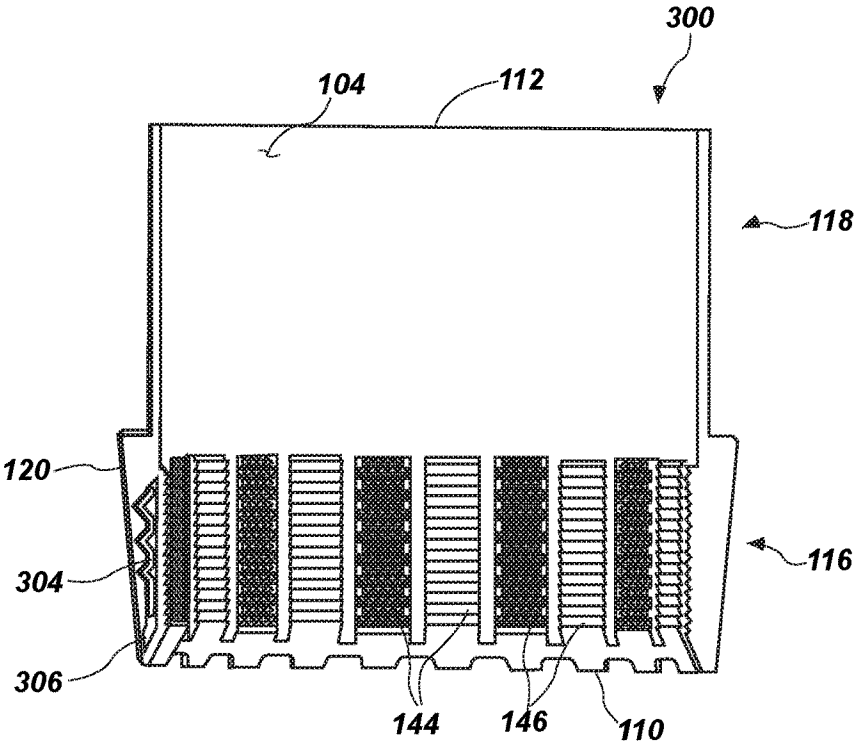

FIGS. 7A-7C illustrate a perspective view, a cross-sectional view, and an enlarged cross-sectional view of a core catcher 300 according to other embodiments of the present disclosure. The core catcher 300 includes a slit 122 extending at least partially along the height of the sleeve 102 between the lower end 110 and the upper end 112 and a bridging element 302. The bridging element 302 may comprise a crosspiece 304 and a track 306 formed on opposing sides of the slit 122. The crosspiece 304 may extend at least partially about the circumference of the sleeve 102, across the slit 122, and into the track 306, which may also extend at least partially about the circumference of the sleeve 102. The track 306 may be formed by openings 308 formed in a one or more wedge-shaped projections 120 and by one or more projections 310 extending between and connecting the wedge-shaped projections 120. As illustrated in FIG. 7A, the projections 310 may be axially spaced apart and provide openings 311 therebetween.

Like the crosspiece 132, at least a portion of the crosspiece 304 may be coupled to or formed integral with the sleeve 102. For example, as illustrated in FIG. 7A, a first circumferential end 312 of the crosspiece 304 may be attached to the first side surface 124 of the sleeve 102. The crosspiece 304 may be slidably engaged with the track 306 at a second circumferential end (not shown) opposite the first end 312.

As best illustrated in the cross-sectional views of FIGS. 7B and 7C, the crosspiece 304 includes track engagement features that may be configured to engage complementary crosspiece engagement features as the crosspiece 304 moves with the track 306 as the diameter of the core catcher 300 expands and contracts. The crosspiece 304 may have a corrugated shape including alternating ridges 318 and planes 316. The opening 308 of the track 306 may have complementary shaped features including recesses 320 into which the ridges 318 may extend. As best illustrated in FIG. 7A, the ridges 318 of the corrugated shape may extend at least partially through openings 311 between the projections 310 between wedge-shaped projections 120.

Figure 8B:
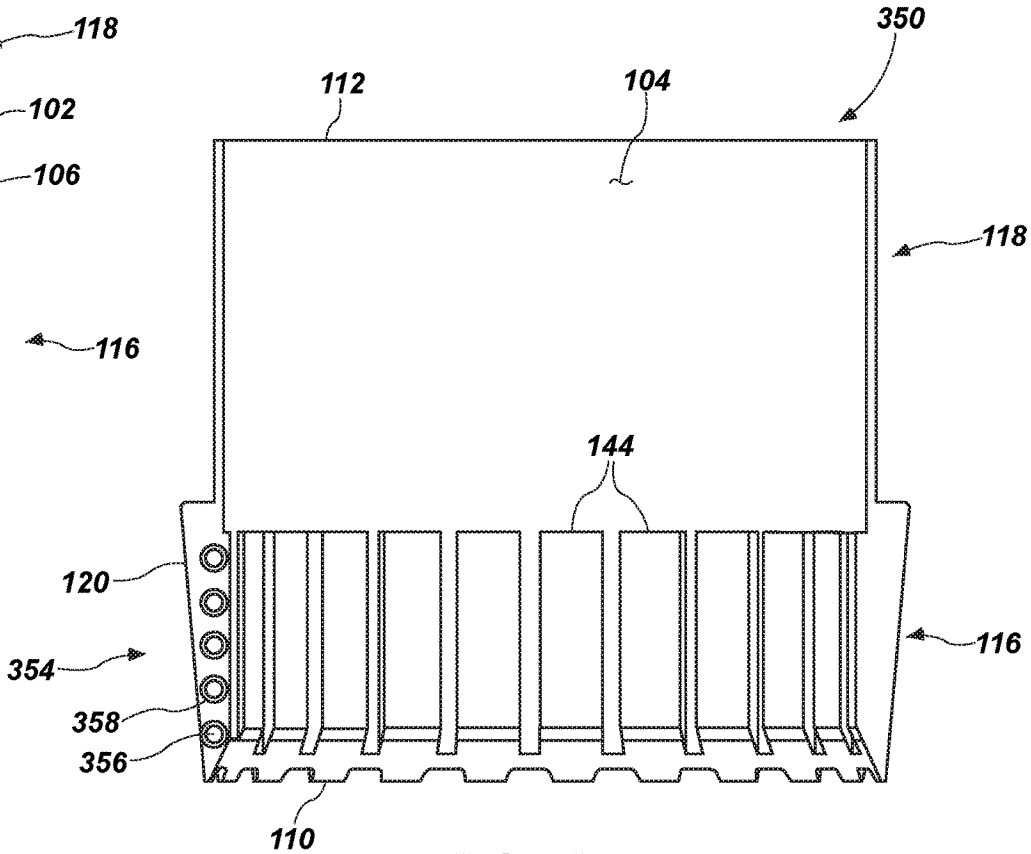
FIGS. 8A and 8B illustrate a perspective view and a cross-sectional view, respectively, of a core catcher according to other embodiments of the disclosure.
Figure 8A:
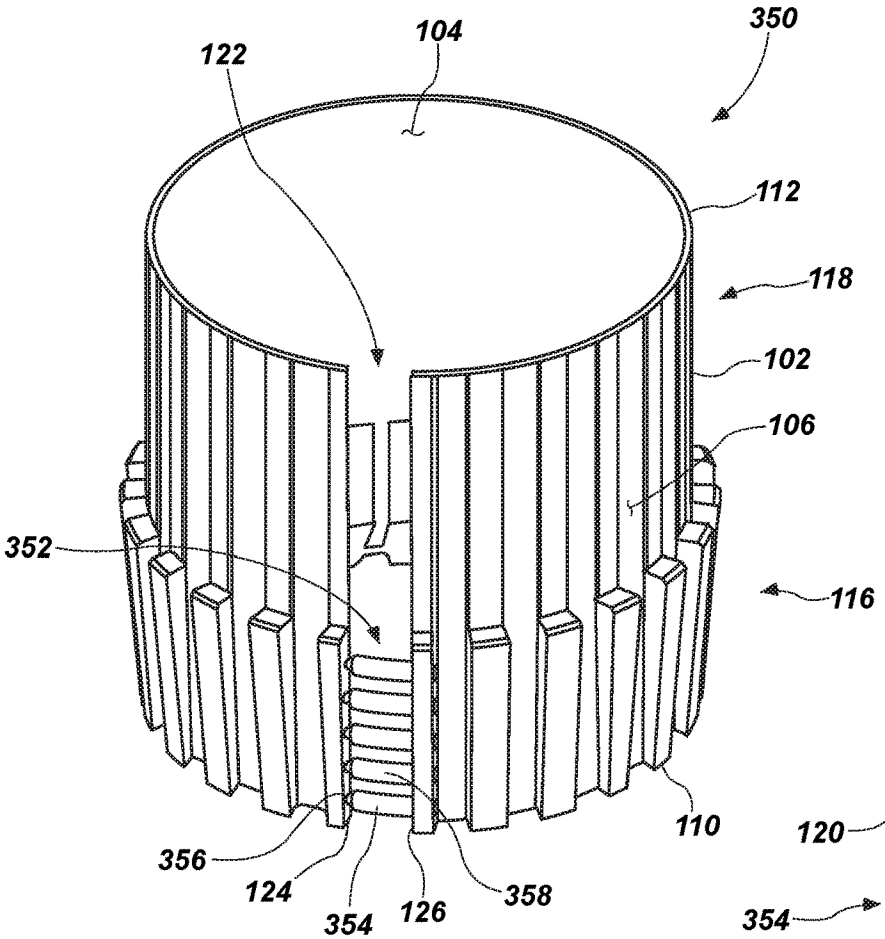

FIGS. 8A and 8B illustrate perspective and cross-sectional views, respectively, of a core catcher 350 according to other embodiments of the disclosure. Like the core catcher 100, the core catcher 350 includes a slit 122 extending at least partially along the height of the sleeve 102 between the lower end 110 and the upper end 112 and a bridging element 352. The bridging element 352 may comprise one or more crosspieces 354 extending between the first side surface 124 and the second side surface 126 across the slit 122. Each crosspiece 354 may comprise a telescoping element including an inner member 356 that is sized and configured to move within an outer member 358 as the core catcher 350 increases and decreases in diameter as previously described. The crosspiece 354 may be coupled to or formed integral with each of the first side surface 124 and the second side surface 126 such that the inner member 356 and the outer member 358 are attached to opposing side surfaces 124, 126.

Figure 9B:
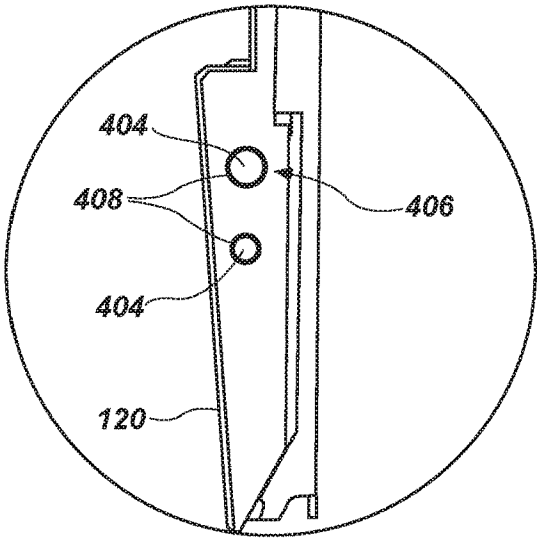
FIGS. 9A, 9B, and 9C illustrate a perspective view and alternative, enlarged cross-sectional views, respectively, of a core catcher according to additional embodiments of the disclosure.
Figure 9C:
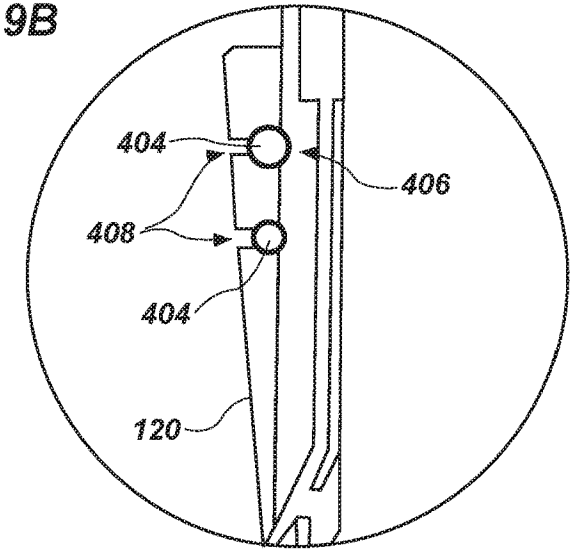
Figure 9A:
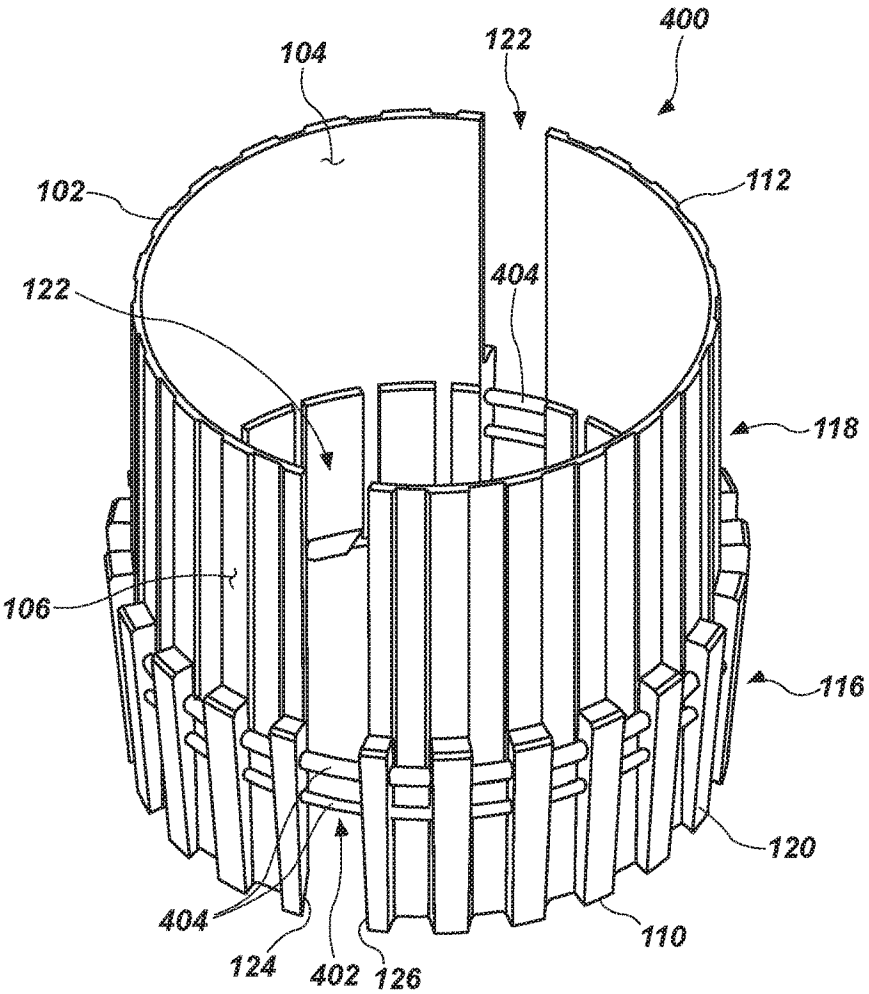

FIG. 9A illustrates a perspective view of a core catcher 400 according to additional embodiments of the disclosure. The core catcher 400 includes a plurality of slits 122. Each slit 122 extends at least partially along the height of the sleeve 102 between the lower end 110 and the upper end 112. The core catcher 400 comprises a bridging element 402 including at least one crosspiece 404 extending across each slit 122 and into at least one track 406 (FIGS. 9B and 9C). As illustrated in FIG. 9A, the core catcher 400 comprises two discrete crosspieces 404 extending through two discrete tracks 406 axially spaced apart from each other. In some embodiments, each crosspiece 404 extends entirely about the circumference of the sleeve 102. In other embodiments, the crosspiece 404 may extend partially about the circumference of the sleeve 102 such that one or more discrete crosspieces 404 extend across each of the plurality of slits 122.

The crosspiece 404 may comprise a flexible or elastic element that may expand and contract in length within the track 406 as the sleeve 102 increases and decreases in diameter. For example, the crosspiece 404 may comprise a spring or a rubber element. In some embodiments, the crosspiece 404 may be uncoupled from the sleeve 102. In such embodiments, the crosspiece 404 may be coupled to itself or formed as a continuous element extending about the sleeve 102. The track 406 may comprise a plurality of openings 408 (FIGS. 9B and 9C) extending through one or more of the wedge-shaped projections 120. In embodiments in which the crosspiece 404 extends entirely about the circumference of the sleeve, each of the wedge-shaped projections 120 may comprise an opening extending therethrough.

FIGS. 9B and 9C are enlarged partial cross-sectional views of a wedge-shaped projection 120 including openings 408 extending therethrough according to embodiments of the present disclosure. As illustrated in the cross-sectional view of FIG. 9B, in some embodiments the openings 408 may comprise a closed, cylindrical opening extending through the wedge-shaped projection 120. As illustrated in the cross-sectional view of FIG. 9C, the opening 408 may be open and form, for example, a C-shaped opening through the wedge-shaped projection 120.

Figure 10:
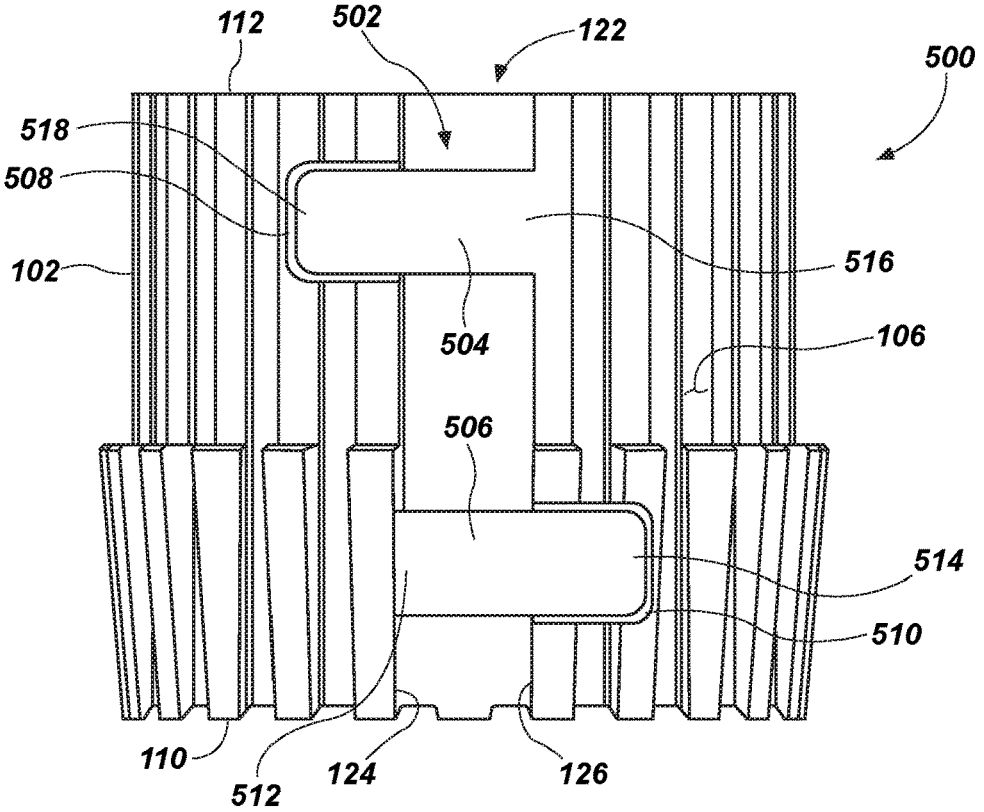
FIG. 10 is a side view of a core catcher according to other embodiments of the present disclosure.

FIG. 10 is a side view of a core catcher 500 according to other embodiments of the present disclosure. The core catcher 500 may comprise a bridging element 502 including at least two discrete crosspieces 504, 506. Each crosspiece 504, 506 may extend at least partially about the circumference of the sleeve 102, across the slit 122, and into respective tracks 508, 510, which may also extend at least partially about the circumference of the sleeve 102. The tracks 508, 510 may comprise a recess formed in the outer surface 106 of the sleeve 102. The respective crosspieces 504, 506 and tracks 508, 510 may be formed on opposing sides of the slit 122. To retain the crosspieces 504, 506 in the respective tracks 508, 510, the recess of the tracks 508, 510 may have a complementary shape to the crosspieces 504, 506. For example, the crosspieces 504, 506 and tracks 508, 510 may have shapes similar to those previously discussed regarding FIGS. 4A-4C, 5A, and 5B or any other complementary shape including, but not limited to triangular, semicircular, rectangular, trapezoidal, and/or diamond shaped.

In some embodiments and as illustrated in FIG. 10, the crosspieces 504, 506 may be axially spaced apart from each other and extend circumferentially about the sleeve 102 in opposing directions. For instance, a first circumferential end 512 of the second crosspiece 506 may be coupled to or integrally formed with the first side surface 124, and a second circumferential end 514 opposite the first end 512 may extend toward and may be slidable within the track 510, which may be formed adjacent to the second side surface 126 of the sleeve 102. A first circumferential end 516 of the first crosspiece 504 may be coupled to or integrally formed with the second side surface 126, and a second circumferential end 518 opposite the first end 516 may extend toward and may be slidably engaged within the track 508, which may be formed adjacent to the first side surface 124 of the sleeve 102. In other embodiments, the crosspieces 504, 506 may extend circumferentially about the sleeve 102 in the same direction such that each crosspiece 504, 506 extends from the first side surface 124 to the second side surface 126 or vice versa.

As illustrated in FIG. 10, the tracks 508, 510 may each be formed about the outer surface 106. In other embodiments, one of the tracks 508, 510 may be formed about the outer surface 106 and the other of the tracks 508, 510 may be formed about the inner surface 104 of the sleeve 102. The first and second crosspieces 504, 506 may similarly be formed such that each extends about the sleeve 102 on opposing surfaces thereof. In yet other embodiments, each of the tracks 508, 510 and crosspieces 504, 506 may be formed on the inner surface 104 of the sleeve 102.

Figure 11:
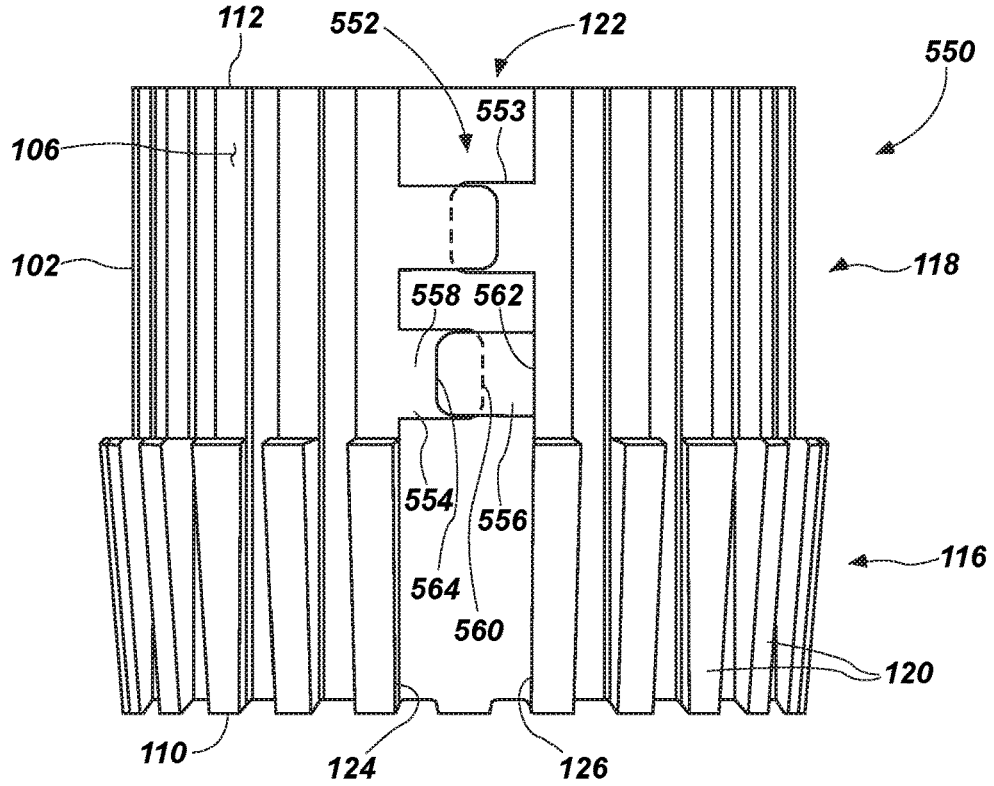
FIG. 11 is a side view of a core catcher according to yet other embodiments of the present disclosure.

FIG. 11 is a side view of a core catcher 550 according to other embodiments of the present disclosure in which elements shown in dashed lines are not visible and elements shown in solid lines are visible in the side view of FIG. 11. The core catcher 550 may comprise a bridging element 552 including a plurality of crosspieces. For instance, the bridging element 552 may comprise two or more pairs 553 of crosspieces. Each pair 553 may comprise a first crosspiece 554 and a second crosspiece 556. The first and second crosspieces 554, 556 may be substantially axially aligned on opposing sides of the slit 122 and may extend in opposing directions at least partially about the circumference of the sleeve 102 and at least partially across the slit 122. More particularly, a first circumferential end 558 of the first crosspiece 554 may be coupled to or formed integral with the first side surface 124, and a second circumferential end 560 may extend toward the second side surface 126. Similarly, a first circumferential end 562 of the second crosspiece 556 may be coupled to or formed integral with the second side surface 126, and a second circumferential end 564 may extend toward the first side surface 124. The respective second circumferential ends 560, 564 of the crosspieces 554, 556 may overlap as each crosspiece 554, 556 extends across the slit 122. As illustrated in FIG. 11, the core catcher 550 includes two pairs 553 of crosspieces. However, the core catcher 550 may include more than two pairs of crosspieces.

While some of the foregoing embodiments of core catchers comprising a bridging element having a crosspiece extending across one slit 122 formed in the sleeve 102, it is contemplated that any of the foregoing core catchers may comprise a plurality of slits 122 extending at least partially along the height of the sleeve 102 as described herein at least with reference to FIG. 9A. In such embodiments, the sleeve 102 may comprise at least one bridging element having a crosspiece extending at least partially across the slit 122. In some embodiments, each slit 122 may comprise a separate or discrete crosspiece. In other embodiments, a crosspiece may extend across more than one slit 122 such that each slit 122 may comprise the same crosspiece extending thereacross as described herein at least with reference to FIG. 9A. Similarly, while the track in which the crosspiece may extend and be slidably engaged has been described in some embodiments as extending adjacent to at least one of the first side surface 124 and the second side surface 126, the track may extend entirely about the outer surface 106 of the sleeve 102. Additionally, while some of the foregoing embodiments of core catchers have been described with reference to one bridging element extending across the slit 122, it is contemplated that any of the foregoing core catchers may comprise a plurality of bridging elements extending at least partially across the slit 122.

In any of the foregoing embodiments of core catchers comprising at least one crosspiece slidably engaged with at least one track, the length of the crosspiece extending within the track may be less than the length of the track. In such embodiments, the track may be greater in length than the portion of the crosspiece extending therein such that a minimum diameter of the core catcher is not limited by contact of a circumferential end of the crosspiece with the end of the track. Similarly, the length of the crosspiece may be sufficient such that a maximum diameter of the core catcher may not be limited by contact of the circumferential end of the crosspiece within the track with the entrance of the track. Rather, the maximum and minimum diameter of the core catcher may be limited by a diameter of the core shoe 42 and, more particular, the minimum and maximum diameter of the tapered portion 50 of the core shoe. In other embodiments, the length of the crosspiece and the length of the track may be sized and configured to limit the maximum and minimum diameter of the core catcher rather than the minimum and maximum diameter of the tapered portion 50 of the core shoe 42 in which the core catcher is housed.

Embodiments of the present disclosure further include methods of forming a core catcher. The core catcher according to any of the foregoing embodiments of the present disclosure may be at least partially formed by an additive manufacturing or 3D printing process. In such embodiments, the core catcher may be formed using a system and method as described in U.S. patent application Ser. No. 15/085,555, entitled "3D-Printing Systems Configured for Advanced Heat Treatment and Related Methods," filed on Mar. 30, 2016, the disclosure of which is incorporated herein in its entirety by this reference. The core catcher according to any of the foregoing embodiments may be at least partially formed by any of the following: rapid prototyping, direct digital manufacturing, layered manufacturing or 3D-printing such stereolithography (STL), digital light processing (DLP), direct metal laser sintering (DMLS), fused deposition modeling (FDM), selective laser sintering (SLS), selective laser melting (SLM), electronic beam melting (EBM), and laminated object manufacturing (LOM). The additive manufacturing process may be used to form a core catcher having grid layers to increase flexibility and decrease rigidity of the core catcher. Additive manufacturing may further enable formation of the core catcher without mechanical fasteners, such as screws, clamps, and the like, which may in operation inhibit already limited movement of the core catcher within the confined and limited space provided by the core shoe. Further, one or more surfaces of the core catcher and the core barrel assembly, such as the core barrel, core shoe, or coring barrel, may be provided with abrasion or wear resistant materials, such as a hardfacing material, provided with or surface treated for corrosion resistance, and/or provided with a material for reducing frictional wear between one or more moving features within the coring tool.

In the additive manufacturing process, the core catcher may be formed (e.g., printed) as a unit such that the core catcher may be fabricated in its final or finished form. In other words, the core catcher may be formed without a need to assemble separate elements of the core catcher together. However, the present disclosure is not so limited and, in other embodiments, one or more elements of the core catcher may be separately formed and assembled together to form the core catcher. By way of example and not limitation, the crosspiece of the bridging element and/or the patterned surfaces according to any of the foregoing embodiments may be separately formed and coupled to the sleeve of the core catcher. In yet other embodiments, the core catcher according to any of the foregoing embodiments may be at least partially formed by casting, sintering, molding, and the like and openings and recesses for the track and for fluid flow may be formed by machining, grinding, and the like.

In some embodiments, the core catcher may be formed of an elastically deformable material. For example, the core catcher may comprise an elastically deformable metal or metal alloy, such as an amorphous metal (i.e., metal glass), a ceramic fiber composite material, other synthetic composite materials, or tungsten carbide materials, such as tungsten carbide grit commercially available from CudaGrit of Madisonville, Ky.

While some of the foregoing embodiments of core catchers having wedge-shaped projections in a conical portion of the sleeve located adjacent a lower end of the sleeve, it is contemplated that the conical portion of the sleeve may located elsewhere along a height of the sleeve. For example, the conical portion may be formed intermediately along a height of the sleeve such that the sleeve comprises two discrete cylindrical portions located above and below the conical portion. Further, the conical portion may be formed adjacent an upper surface of the sleeve. It is further contemplated that the sleeve may have another shape that is configured to allow the core 28 to pass therethrough and to interact with the inner surface 51 of the core shoe 42 to cause the core catcher to constrict around and frictionally engage with the core 28, as previously described herein.

While some of the foregoing embodiments of core catchers have been illustrated such that the first side surface 124 and second side surface 126 of the sleeve 102 extend in parallel and axially in a continuous, linear manner between the lower end 110 and upper end 112 of the sleeve 102, it is contemplated that the slit may have any other shape. For example, the slit may extend in parallel and axially in a discontinuous manner, such as a zig-zag or curved manner.

FIG. 12 is a schematic diagram of an exemplary drilling system 600 in which the core barrel assembly of FIG. 1 and the core catcher of any of the embodiments disclosed herein may be incorporated. The drilling system 600 comprises a drill string 602 carrying a drilling assembly 601 (also referred to as the bottomhole assembly, or "BHA") conveyed in a "wellbore" or "borehole" 612 for drilling the borehole. The drill string 602 may include one or more of: jointed tubular and coiled tubing. The drilling system 600 includes a conventional derrick 604 erected on a floor 606 which supports a rotary table 608 that is rotated by a prime mover such as an electric motor (not shown) at a desired rotational speed. The drill string 602 includes tubing such as a drill pipe 610 or a coiled-tubing extending downward from the surface into the borehole 612. The drill string 602 may be pushed into the borehole 612 when a drill pipe 610 is used as the tubing. For coiled-tubing applications, a tubing injector, such as an injector (not shown), however, is used to move the tubing from a source thereof, such as a reel (not shown), to the borehole 612. The drill bit assembly 614 attached to the end of the drill string 602 breaks up the geological formations when it is rotated to drill the borehole 612. If a drill pipe 610 is used, the drill string 602 may be coupled to a drawworks 616 via a kelly joint 618, swivel 620, and line 622 through a pulley 624. During drilling operations, the drawworks 616 may be operated to control the weight on bit, which is an important parameter that affects the rate of penetration. The operation of the drawworks is well known in the art and is thus not described in detail herein.

During drilling operations, a suitable drilling fluid 626 from a mud pit (source) 628 may be circulated under pressure through a channel in the drill string 602 by a mud pump 630. The drilling fluid 626 passes from the mud pump 630 into the drill string 602 via a desurger (not shown), fluid line 632, and kelly joint 618. The drilling fluid 626 may be discharged at the borehole bottom 634 through an opening in the drill bit assembly 614, as previously described herein with reference to the core bit 6 of FIGS. 1 and 2. The drilling fluid 626 circulates uphole through the annular space 636 between the drill string 602 and the borehole 612 and returns to the mud pit 628 via a return line 638. The drilling fluid 626 acts to lubricate the drill bit assembly 614 and to carry borehole cutting or chips away from the drill bit assembly 614. A sensor $S_1$ placed in the fluid line 632 can provide information about the fluid flow rate. A surface torque sensor $S_2$ and a sensor $S_3$ associated with the drill string 602 provide information about the torque and rotational speed of the drill string 602, respectively. Additionally, a sensor (not shown) associated with line 622 may be used to provide the hook load of the drill string 602.

In some embodiments of the present disclosure, the drill bit assembly 614 may be rotated by only rotating the drill pipe 610. In other embodiments of the present disclosure, a downhole motor 640 (mud motor) may be disposed in the drilling assembly 601 to rotate the drill bit assembly 614, and the drill pipe 610 may be rotated usually to supplement the rotational power, if required, and to effect changes in the drilling direction.

The mud motor 640 may be coupled to the drill bit assembly 614 via a drive shaft (not shown) disposed in a bearing assembly 642. The mud motor 640 rotates the drill bit assembly 614 when the drilling fluid 626 passes through the mud motor 640 under pressure. The bearing assembly 642 supports the radial and axial forces of the drill bit assembly 614. A stabilizer 644 coupled to the bearing assembly 642 acts as a centralizer for the lowermost portion of the mud motor assembly.

A drilling sensor module 646 may be placed near the drill bit assembly 614. Drill bit assembly 614 may include one or more of: (i) a drill bit, (ii) a drill bit box, (iii) a drill collar, and (iv) a storage sub. The drilling sensor module 646 may contain sensors, circuitry, and processing software and algorithms relating to the dynamic drilling parameters. Such parameters can include bit bounce, stick-slip of the drilling assembly, backward rotation, torque, shocks, borehole and annulus pressure, acceleration measurements, and other measurements of the drill bit assembly condition. A suitable telemetry or communication sub 648 using, for example, two-way telemetry, may also be provided as illustrated in the drilling assembly 601. The drilling sensor module 646 processes the sensor information and transmits it to the surface control unit 654 via the communication sub 648.

The communication sub 648, a power unit 650, and an MWD tool 652 may all be connected in tandem with the drill string 602. Flex subs, for example, are used in connecting the MWD tool 652 in the drilling assembly 601. Such subs and tools may form the bottom hole drilling assembly 601 between the drill string 602 and the drill bit assembly 614. The drilling assembly 601 may make various measurements including the pulsed nuclear magnetic resonance measurements while the borehole 612 is being drilled. The communication sub 648 obtains the signals and measurements and transfers the signals, using two-way telemetry, for example, to be processed on the surface. Alternatively, the signals can be processed using a downhole processor at a suitable location (not shown) in the drilling assembly 601.

The surface control unit or processor 654 may also receive one or more signals from other downhole sensors and devices and signals from sensors $S_1$-$S_3$ and other sensors used in the system 600 and processes such signals according to programmed instructions provided to surface control unit 654. The surface control unit 654 may display desired drilling parameters and other information on a display/monitor 656 utilized by an operator to control the drilling operations. The surface control unit 654 can include a computer or a microprocessor-based processing system, memory for storing programs or models and data, a recorder for recording data, and other peripherals. The surface control unit 654 can be adapted to activate alarms 658 when certain unsafe or undesirable operating conditions occur.

The apparatus for use with the present disclosure may include one or more downhole processors that may be positioned at any suitable location within or near the bottom hole assembly. The processor(s) may include a microprocessor that uses a computer program implemented on a suitable machine-readable medium that enables the processor to perform the control and processing. The machine-readable medium may include ROMs, EPROMs, EAROMs, EEPROMs, Flash Memories, RAMs, Hard Drives and/or Optical disks. Other equipment such as power and data buses, power supplies, and the like will be apparent to one skilled in the art.

Additional non-limiting example embodiments of the disclosure are described below.

Embodiment 1

A core catcher for a coring tool comprising a sleeve comprising a longitudinal axis and at least one slit extending at least partially along a height of the sleeve between an upper end and a lower end thereof. The at least one slit separates a first side surface and a second side surface of the sleeve, wherein the first side surface is located a first distance from the longitudinal axis and the second side surface is located a second distance from the longitudinal axis. Each of the first distance and the second distance measured in a direction transverse to the longitudinal axis. The core catcher also comprises a bridging element extending at least partially about a perimeter of the sleeve. The bridging element operatively couples movement of the first side surface and the second side surface to limit a difference between the first distance and the second distance as a width of the at least one slit that separates the first side surface and the second side surface increases or decreases.

Embodiment 2

The core catcher of Embodiment 1, wherein the bridging element operatively couples movement of the first side surface and the second side surface such that the difference between the first distance and the second distance is less than a thickness of the sleeve as the width of the at least one slit increases or decreases, wherein the thickness measured between an inner surface and an outer surface of the sleeve.

Embodiment 3

The core catcher of either of Embodiments 1 or 2, wherein the bridging element operatively couples movement of the first side surface and the second side surface such that the difference between the first distance and the second distance is substantially zero as the width of the at least one slit increases or decreases.

Embodiment 4

The core catcher of any of Embodiments 1 through 3, wherein the bridging element comprises at least one crosspiece extending at least partially about the perimeter of the sleeve and extending at least partially across the at least one slit.

Embodiment 5

The core catcher of any of Embodiments 1 through 4, wherein the bridging element further comprises at least one track extending at least partially about the perimeter of the sleeve, and wherein the at least one crosspiece is slidably engaged with the at least one track.

Embodiment 6

The core catcher of any of Embodiments 1 through 5, wherein the at least one crosspiece is retained about the core catcher within the at least one track and is movable relative to each of the first side surface and the second side surface.

Embodiment 7

The core catcher of any of Embodiments 1 through 6, wherein the at least one track comprises at least one recess and wherein the at least one crosspiece comprises at least one complementary shaped projection extending into the at least one recess to retain the at least one crosspiece within the at least one track.

Embodiment 8

The core catcher of any of Embodiments 1 through 7, wherein the at least one crosspiece has a shape that inhibits the crosspiece from being removed from the at least one track.

Embodiment 9

The core catcher of any of Embodiments 1 through 8, wherein the bridging element comprises a first crosspiece attached to the sleeve and extending at least partially about the perimeter of the sleeve and at least partially across the at least one slit toward the second side surface and comprises a second crosspiece attached to the sleeve and extending at least partially about the perimeter of the sleeve and at least partially across the at least one slit toward the first side surface, wherein the first crosspiece and the second crosspiece at least partially overlap.

Embodiment 10

The core catcher of any of Embodiments 1 through 9, wherein the sleeve further comprises a plurality of openings extending radially between an inner surface and an outer surface of the sleeve.

Embodiment 11

The core catcher of any of Embodiments 1 through 10, wherein the at least one crosspiece comprises at least one of an elastic element, a spring, and a telescoping element.

Embodiment 12

The core catcher of any of Embodiments 1 through 11, wherein at least one of the sleeve and the bridging element comprises an additive manufactured structure.

Embodiment 13

A coring tool for extracting a core of subterranean formation from a wellbore comprising a tube having a central bore configured to receive the sample of the subterranean formation and a core catcher housed within the central bore of the tube. The core catcher comprises a sleeve comprising a longitudinal axis and at least one slit extending at least partially along a height of the sleeve between an upper end and a lower end thereof. The at least one slit separates a first side surface and a second side surface of the sleeve, wherein the first side surface is located a first distance from the longitudinal axis and the second side surface is located a second distance from the longitudinal axis. Each of the first distance and the second distance are measured in a direction transverse to the longitudinal axis. The core catcher also comprising a bridging element extending at least partially about a perimeter of the sleeve. The bridging element operatively couples movement of the first side surface and the second side surface to limit a difference between the first distance and the second distance as a width of the at least one slit that separates the first side surface and the second side surface increases or decreases.

Embodiment 14

The coring tool of Embodiment 13, where the bridging element operatively couples movement of the first side surface and the second side surface such that the difference between the first distance and the second distance is substantially zero as the width of the at least one slit increases or decreases.

Embodiment 15

The coring tool of either of Embodiments 13 or 14, wherein the core catcher further comprises at least one track extending at least partially about the circumference of the sleeve, and wherein at least one crosspiece is slidably engaged with the at least one track.

Embodiment 16

The coring tool of any of Embodiments 13 through 15, wherein each of the at least one crosspiece and the at least one track is integrally formed with the sleeve.

Embodiment 17

The coring tool of any of Embodiments 13 through 16, wherein the at least one crosspiece comprises a recess formed in an inner surface of the at least one crosspiece, the at least one recess sized and configured to provide fluid flow between the at least one crosspiece and the at least one track.

Embodiment 18

The coring tool of any of Embodiments 13 through 17, wherein a first circumferential end of the at least one crosspiece is fixed to the sleeve and a second circumferential end of the at least one crosspiece is unfixed from the sleeve.

Embodiment 19

The coring tool of any of Embodiments 13 through 18, wherein the at least one crosspiece varies in height between the first circumferential end and the second circumferential end.

Embodiment 20

A method for extracting a core of subterranean formation from a wellbore comprising cutting a core of subterranean formation material from a subterranean formation and receiving the core in a core catcher. The core catcher comprises a sleeve comprising a longitudinal axis and at least one slit extending at least partially along a height of the sleeve between an upper end and a lower end thereof. The at least one slit separates a first side surface and a second side surface of the sleeve, wherein the first side surface is located a first distance from the longitudinal axis and the second side surface is located a second distance from the longitudinal axis. Each of the first distance and the second distance is measured in a direction transverse to the longitudinal axis. The core catcher also comprises a bridging element extending at least partially about a perimeter of the sleeve. The method further comprises receiving the core catcher having the core therein within a central bore of a core shoe, wherein receiving the core catcher comprises reducing a width of the at least one slit that separates the first side surface and the second side surface while maintaining a difference between the first distance and the second distance at substantially zero.

Embodiments of the disclosure are susceptible to various modifications and alternative forms. Specific embodiments have been shown in the drawings and described in detail herein to provide illustrative examples of embodiments of the disclosure. However, the disclosure is not limited to the particular forms disclosed herein. Rather, embodiments of the disclosure may include all modifications, equivalents, and alternatives falling within the scope of the disclosure as broadly defined herein. Furthermore, elements and features described herein in relation to some embodiments may be implemented in other embodiments of the disclosure, and may be combined with elements and features described herein in relation to other embodiments to provide yet further embodiments of the disclosure.

What is claimed is:

1. A core catcher for a coring tool, comprising:

a sleeve comprising:

a longitudinal axis; and at least one slit extending at least partially along a height of the sleeve between an upper end and a lower end thereof, the at least one slit separating a first side surface and a second side surface of the sleeve, wherein the first side surface is located a first distance from the longitudinal axis and the second side surface is located a second distance from the longitudinal axis, each of the first distance and the second distance measured in a direction transverse to the longitudinal axis; and a bridging element extending at least partially about a perimeter of the sleeve, the bridging element operatively coupling movement of the first side surface and the second side surface to limit a difference between the first distance and the second distance as a width of the at least one slit that separates the first side surface and the second side surface increases or decreases;

wherein the bridging element comprises at least one crosspiece extending at least partially about the perimeter of the sleeve and extending at least partially across the at least one slit, wherein the bridging element further comprises at least one track extending at least partially about the perimeter of the sleeve, and wherein the at least one crosspiece is slidably engaged with the at least one track.

2. The core catcher of claim 1, wherein the bridging element operatively couples movement of the first side surface and the second side surface such that the difference between the first distance and the second distance is less than a thickness of the sleeve as the width of the at least one slit increases or decreases, wherein the thickness measured between an inner surface and an outer surface of the sleeve.

3. The core catcher of claim 1, where the bridging element operatively couples movement of the first side surface and the second side surface such that the difference between the first distance and the second distance is substantially zero as the width of the at least one slit increases or decreases.

4. The core catcher of claim 1, wherein the at least one crosspiece is retained about the core catcher within the at least one track and is movable relative to each of the first side surface and the second side surface.

5. The core catcher of claim 1, wherein the at least one track comprises at least one recess and wherein the at least one crosspiece comprises at least one complementary shaped projection extending into the at least one recess to retain the at least one crosspiece within the at least one track.

6. The core catcher of claim 1, wherein the at least one crosspiece has a shape that inhibits the crosspiece from being removed from the at least one track.

7. The core catcher of claim 1, wherein the bridging element comprises:

a first crosspiece attached to the sleeve and extending at least partially about the perimeter of the sleeve and at least partially across the at least one slit toward the second side surface;

a second crosspiece attached to the sleeve and extending at least partially about the perimeter of the sleeve and at least partially across the at least one slit toward the first side surface; and the first crosspiece and the second crosspiece at least partially overlap.

8. The core catcher of claim 1, wherein the sleeve further comprises a plurality of openings extending radially between an inner surface and an outer surface of the sleeve.

9. The core catcher of claim 1, wherein the at least one crosspiece comprises at least one of an elastic element, a spring, and a telescoping element.

10. The core catcher of claim 1, wherein at least one of the sleeve and the bridging element comprises an additive manufactured structure.

11. A coring tool for extracting a core of subterranean formation from a wellbore, comprising:

a tube having a central bore configured to receive a sample of a subterranean formation; and a core catcher housed within the central bore of the tube and comprising:

a sleeve comprising:

a longitudinal axis; and at least one slit extending at least partially along a height of the sleeve between an upper end and a lower end thereof, the at least one slit separating a first side surface and a second side surface of the sleeve, wherein the first side surface is located a first distance from the longitudinal axis and the second side surface is located a second distance from the longitudinal axis, each of the first distance and the second distance measured in a direction transverse to the longitudinal axis;

a bridging element extending at least partially about a perimeter of the sleeve, the bridging element operatively coupling movement of the first side surface and the second side surface to limit a difference between the first distance and the second distance as a width of the at least one slit that separates the first side surface and the second side surface increases or decreases; and at least one track extending at least partially about a circumference of the sleeve, and wherein at least one crosspiece of the bridging element is slidably engaged with the at least one track.

12. The core catcher of claim 11, where the bridging element operatively couples movement of the first side surface and the second side surface such that the difference between the first distance and the second distance is substantially zero as the width of the at least one slit increases or decreases.

13. The coring tool of claim 11, wherein each of the at least one crosspiece and the at least one track is integrally formed with the sleeve.

14. The coring tool of claim 13, wherein the at least one crosspiece comprises a recess formed in an inner surface of the at least one crosspiece, the recess sized and configured to provide fluid flow between the at least one crosspiece and the at least one track.

15. The coring tool of claim 11, wherein a first circumferential end of the at least one crosspiece is fixed to the sleeve and a second circumferential end of the at least one crosspiece is unfixed from the sleeve.

16. The coring tool of claim 15, wherein the at least one crosspiece varies in height between the first circumferential end and the second circumferential end.

17. A method for extracting a core of subterranean formation from a wellbore, comprising:

cutting a core of subterranean formation material from a subterranean formation;

receiving the core in a core catcher, the core catcher comprising:

a sleeve comprising:

a longitudinal axis; and at least one slit extending at least partially along a height of the sleeve between an upper end and a lower end thereof, the at least one slit separating a first side surface and a second side surface of the sleeve, wherein the first side surface is located a first distance from the longitudinal axis and the second side surface is located a second distance from the longitudinal axis, each of the first distance and the second distance measured in a direction transverse to the longitudinal axis;

a bridging element extending at least partially about a perimeter of the sleeve; and wherein the bridging element comprises at least one crosspiece extending at least partially about the perimeter of the sleeve and extending at least partially across the at least one slit, wherein the bridging element further comprises at least one track extending at least partially about the perimeter of the sleeve, and wherein the at least one crosspiece is slidably engaged with the at least one track; and receiving the core catcher having the core therein within a central bore of a core shoe, wherein receiving the core catcher comprises reducing a width of the at least one slit that separates the first side surface and the second side surface while maintaining a difference between the first distance and the second distance at substantially zero.

* * * * *